US009166273B2

(12) United States Patent
van Niekerk

(10) Patent No.: US 9,166,273 B2
(45) Date of Patent: Oct. 20, 2015

(54) CONFIGURATIONS FOR ANTENNAS

(71) Applicant: Sonos, Inc., Santa Barbara, CA (US)

(72) Inventor: Carlo van Niekerk, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 179 days.

(21) Appl. No.: 14/042,056

(22) Filed: Sep. 30, 2013

(65) Prior Publication Data

US 2015/0091761 A1 Apr. 2, 2015

(51) Int. Cl.

| | |
|---|---|
| ***H01Q 13/10*** | (2006.01) |
| ***H01Q 1/24*** | (2006.01) |
| ***H01Q 1/00*** | (2006.01) |
| ***H01Q 1/52*** | (2006.01) |
| ***H01Q 21/30*** | (2006.01) |

(52) U.S. Cl.
CPC ..... *H01Q 1/007* (2013.01); *H01Q 1/521* (2013.01); *H01Q 21/30* (2013.01)

(58) Field of Classification Search
CPC ..... H01Q 1/24; H01Q 13/10
USPC ..... 343/702, 770, 720
See application file for complete search history.

(56) References Cited

U.S. PATENT DOCUMENTS

| | | | |
|---|---|---|---|
| 5,930,376 | A | 7/1999 | Markow et al. |
| 6,531,985 | B1 | 3/2003 | Jones et al. |
| 6,667,719 | B2 | 12/2003 | LaKomski |
| 8,531,344 | B2 * | 9/2013 | Ayatollahi et al. ..... 343/793 |
| 8,552,913 | B2 * | 10/2013 | Ayatollahi et al. ..... 343/702 |
| 2004/0227679 | A1 | 11/2004 | Lu |
| 2010/0008030 | A1 | 1/2010 | Weber et al. |
| 2010/0125878 | A1 | 5/2010 | Jing et al. |
| 2010/0321253 | A1 | 12/2010 | Ayala Vazquez et al. |
| 2010/0321553 | A1 | 12/2010 | Margolin |
| 2011/0050508 | A1 | 3/2011 | Guterman et al. |
| 2013/0016870 | A1 | 1/2013 | Chen et al. |

OTHER PUBLICATIONS

United States Patent and Trademark Office "Non-final Office Action," issued in connection with U.S. Appl. No. 13/183,052, May 22, 2014, 17 pages.
United States Patent and Trademark Office "Final Office Action," issued in connection with U.S. Appl. No. 13/183,052, Dec. 3, 2014, 18 pages.
United States Patent and Trademark Office "Non-final Office Action," issued in connection with U.S. Appl. No. 13/183,052, Mar. 17, 2015, 22 pages.

(Continued)

*Primary Examiner* — Hoang V Nguyen

(57) ABSTRACT

Embodiments are provided for antenna configurations. An example playback device includes a housing having a metallic face, the metallic face including an opening; a first antenna oriented in a first direction on a plate, the plate forming a ground plane for the first antenna, the first antenna having a first slot aligned with the opening, the first antenna being associated with a first frequency; and a second antenna positioned proximate to the first antenna on the plate and oriented in a second direction opposing the first direction, the second antenna having a second slot aligned with the opening, the second antenna being associated with at least the first frequency, and the second antenna having at least a first portion located at a distance from at least a second portion of the first antenna of one quarter wavelength of the first frequency.

20 Claims, 15 Drawing Sheets

(56) References Cited

OTHER PUBLICATIONS

United States Patent and Trademark Office "Non-final Office Action," issued in connection with U.S. Appl. No. 13/183,052, Oct. 10, 2013, 16 pages.

United States Patent and Trademark Office "Non-final Office Action," issued in connection with U.S. Appl. No. 13/183,052, Feb. 28, 2013, 20 pages.

* cited by examiner

CONFIGURATIONS FOR ANTENNAS

FIELD OF THE DISCLOSURE

The disclosure is related to consumer goods and, more particularly, to methods, systems, products, features, services, and other items directed to media playback or some aspect thereof.

BACKGROUND

Digital music has become readily available due in part to the development of consumer level technology that has allowed people to listen to digital music on a personal audio device. The consumer's increasing preference for digital audio has also resulted in the integration of personal audio devices into PDAs, cellular phones, and other mobile devices. The portability of these mobile devices has enabled people to take the music listening experience with them and outside of the home. People have become able to consume digital music, like digital music files or even Internet radio, in the home through the use of their computer or similar devices. Now there are many different ways to consume digital music, in addition to other digital content including digital video and photos, stimulated in many ways by high-speed Internet access at home, mobile broadband Internet access, and the consumer's hunger for digital media.

Until recently, options for accessing and listening to digital audio in an out-loud setting were severely limited. In 2005, Sonos offered for sale its first digital audio system that enabled people to, among many other things, access virtually unlimited sources of audio via one or more networked connected zone players, dynamically group or ungroup zone players upon command, wirelessly send the audio over a local network amongst zone players, and play the digital audio out loud in synchrony. The Sonos system can be controlled by software applications downloaded to certain network capable, mobile devices and computers.

Given the insatiable appetite of consumers towards digital media, there continues to be a need to develop consumer technology that revolutionizes the way people access and consume digital media.

BRIEF DESCRIPTION OF THE DRAWINGS

Features, aspects, and advantages of the presently disclosed technology may be better understood with regard to the following description, appended claims, and accompanying drawings where:

Figure 1:
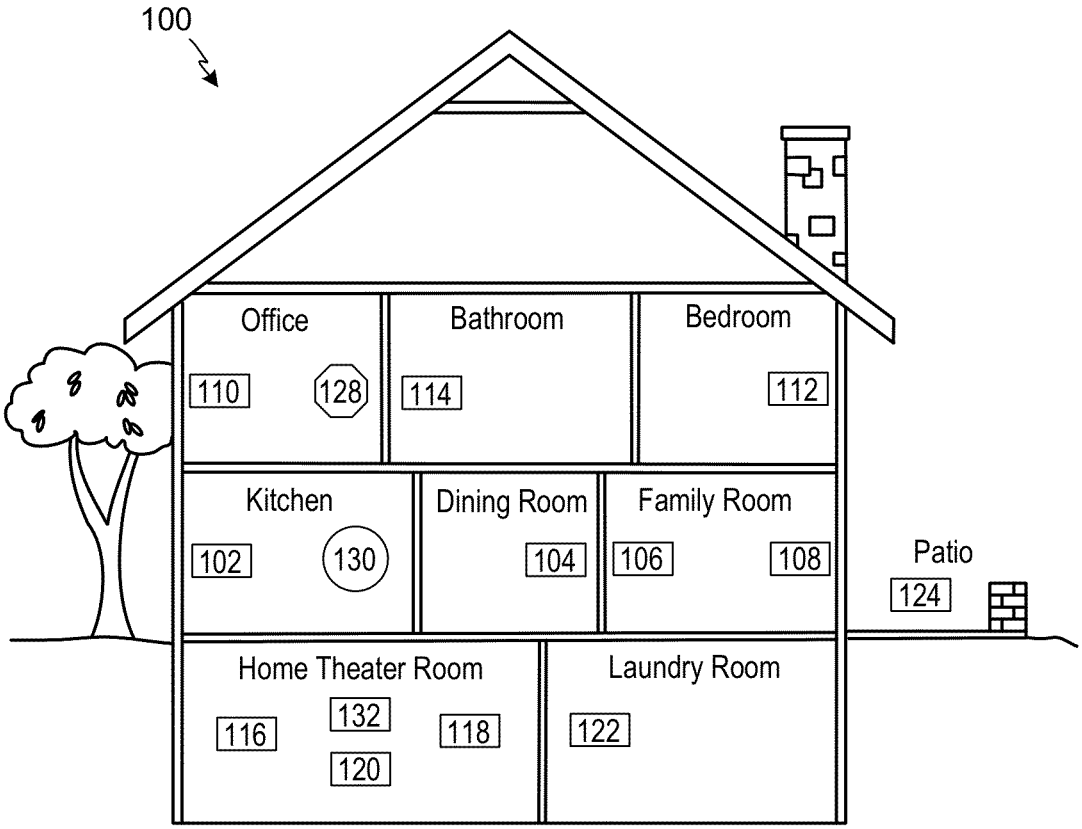
FIG. 1 shows an example configuration in which certain embodiments may be practiced.

In addition, the drawings are for the purpose of illustrating example embodiments, but it is understood that the inventions are not limited to the arrangements and instrumentality shown in the drawings.

DETAILED DESCRIPTION

I. Overview

Electronic devices can receive signals in a plurality of manners using different techniques and/or technologies. In some examples, content such as music is encoded onto a carrier signal that is then wirelessly transmitted from one or more sources to one or more wireless devices. A wireless device typically includes one or more antennas to wirelessly receive the signal representative of the content. The antenna(s) receives the wireless signal and provides the signal to, for examples, a processor or computing device of the wireless device.

In comparison with wired devices, wireless devices can be located more freely throughout an environment, such as a house. In such instances, a signal source transmits a wireless signal into the environment and wireless devices within range of the signal source receive the wireless signal. Because the placement of a wireless device relative to the signal source is unpredictable, wireless devices benefit from an ability to receive wireless signals from an omni-directional standpoint. That is, it is advantageous for wireless devices to be able to receive a wireless signal from any and all directions. The range, scope or span of the directions from which the wireless playback device can receive (or transmit) signals is sometimes referred to as coverage. To provide wide coverage, some wireless devices include more than one antenna to realize multiple, different radiation patterns having different coverages.

However, placement of the antennas within a wireless device may present challenges. For example, certain materials or surfaces of the wireless playback device may affect a manner or quality in which the antenna(s) transmit, receive, or transmit and receive signals. A metallic portion of a playback device housing affects or interferes with reception of the wireless signal to a first degree or magnitude, while a plastic portion of a playback device housing affects or interferes with reception of the wireless signal to a second degree or magnitude different from (typically less than) the first degree or magnitude. The degree or magnitude at which a certain material adversely affects transmission and/or reception of a wireless signal is sometimes referred to herein as an interference factor and results from, for example, one or more different characteristics of the respective materials, such as capacitance, reflective properties, dielectric properties, etc.

To avoid or reduce effect(s) of a high-interface component, some wireless devices position an antenna adjacent to or behind low-interference portions of the device, such as a plastic wall or portion of a housing. However, in some instances, the surface area have the low-interference factor is small. For example, an antenna may be placed behind a small plastic cover that is positioned in an opening of a metallic surface, such as a grill. In such instances, the cover or other type of low-interference component may have a small amount of surface area behind which the antenna may be positioned. Therefore, utilizing multiple antennas having different radiation patterns in such instances is difficult. For one, the small amount of space is restrictive. Moreover, because antenna performance may be negatively affected by a lack of isolation from another antenna, placing multiple antennas close to each other presents challenges.

Embodiments disclosed herein enable multiple antennas to be placed in close proximity with each other to provide wide coverage for a wireless device. Embodiments disclosed herein can be used, for example, to populate a small area associated with a low interference component or surface with the multiple antennas to provide a plurality of different radiation patterns in one or more particular directions. For example, as described in detail below, embodiments disclosed herein provide first and second slot antennas on a ground plane in a configuration that extends first and second, respective, radiation patterns in opposing directions. Further, as described in detail below, embodiments disclosed herein enable each of the first and second slot antennas to support multiple transmission frequencies. For example, embodiments disclosed herein enable both the first and second slot antennas to each support 2.4 GHz and 5 GHz transmission frequencies, while positioned in close proximity to each other. In some examples disclosed herein, the proximity of the antennas is governed by the size of the low-interference component and/or an opening in housing. In such instances, examples disclosed herein enable utilization of multiple antennas when the restrictive size or opening is as small as one quarter wavelength in one direction (e.g., wide) and one half wavelength in another direction (e.g., long). Configurations to enable such antennas are disclosed in detail below.

Additionally, a wireless device may include additional or alternative components that inhibit or otherwise restrict signals from being transmitted or received by the antenna(s). For example, a printed circuit board (PCB) may include one or more metallic components that reflect signals away from the antenna(s). As a result, the range of the wireless playback device is affected by the reflective component(s). Embodiments disclosed herein capacitively couple the a the ground plane of the example antennas disclosed herein with a ground plane of such an reflective component. In doing so, embodiments disclosed herein transform an otherwise interfering component into an extension of the ground plane of the example antennas disclosed herein.

Thus, embodiments disclosed herein improve receiving and transmitting capabilities of wireless devices having one or more components or surfaces made at least in part of metal and/or some other material having a relatively high interference factor.

Other embodiments, as those discussed in the following and others as can be appreciated by one having ordinary skill in the art are also possible.

II. Example Operating Environment

Referring now to the drawings, in which like numerals can refer to like parts throughout the figures, FIG. 1 shows an example media system configuration 100 in which one or more embodiments disclosed herein can be practiced or implemented.

By way of illustration, the media system configuration 100 is associated with a home having multiple zones, though the home could have been configured with only one zone. Additionally, one or more zones can be added over time. Each zone may be assigned by a user to a different room or space, such as, for example, an office, bathroom, bedroom, kitchen, dining room, family room, home theater room, utility or laundry room, and patio. A single zone might also include multiple rooms or spaces if so configured. With respect to FIG. 1, one or more of zone players 102-124 are shown in each respective zone. A zone player 102-124, also referred to herein as a playback device, multimedia unit, speaker, player, and so on, provides audio, video, and/or audiovisual output. A controller 130 (e.g., shown in the kitchen for purposes of this illustration) provides control to the media system configuration 100. Controller 130 may be fixed to a zone, or alternatively, mobile such that it can be moved about the zones. The media system configuration 100 may also include more than one controller 130, and additional controllers may be added to the system over time.

The media system configuration 100 illustrates an example whole house media system, though it is understood that the technology described herein is not limited to, among other things, its particular place of application or to an expansive system like a whole house media system 100 of FIG. 1.

a. Example Zone Players

Figure 2A:
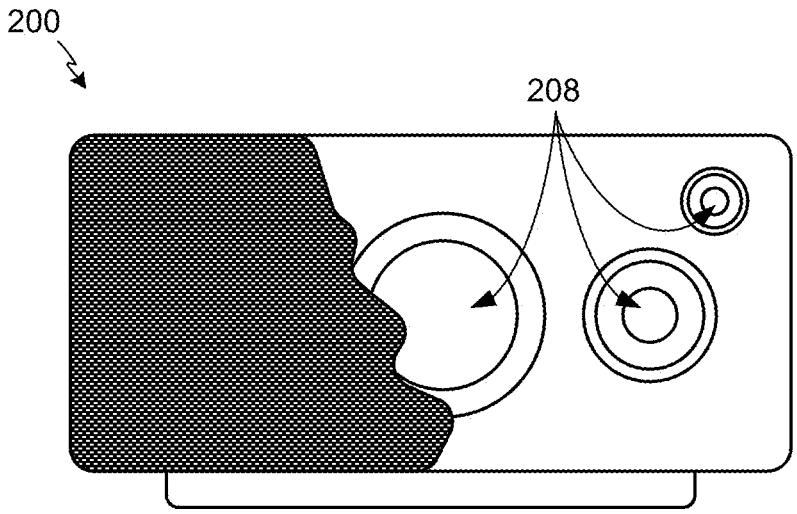
FIG. 2A shows an illustration of an example zone player having a built-in amplifier and transducers.
Figure 2B:
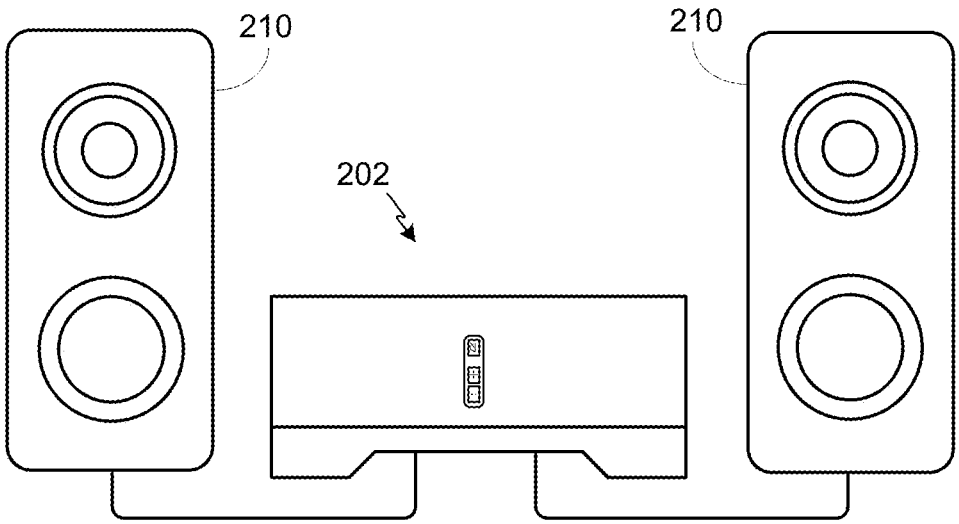
FIG. 2B shows an illustration of an example zone player having a built-in amplifier and connected to external speakers.
Figure 2C:
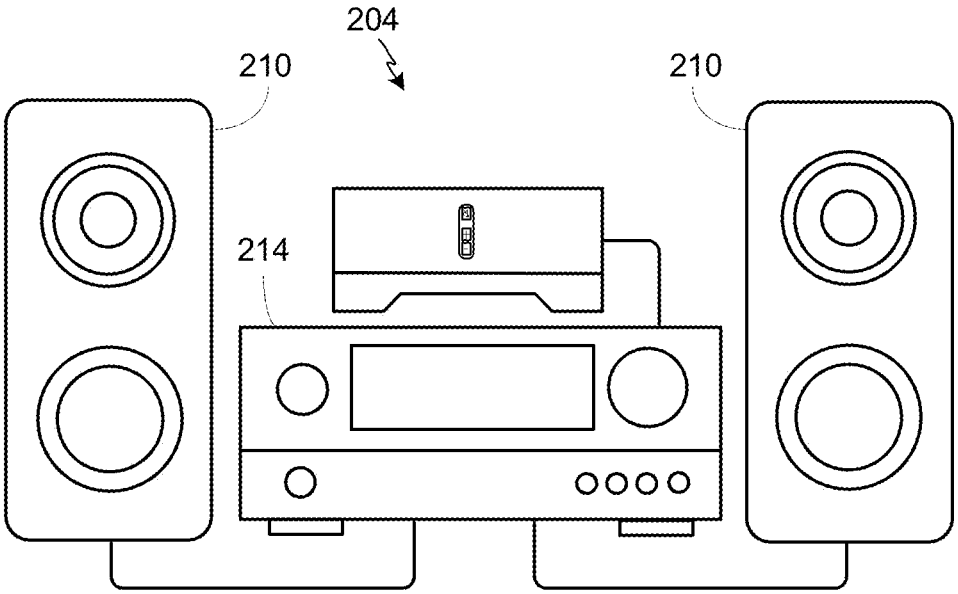
FIG. 2C shows an illustration of an example zone player connected to an A/V receiver and speakers.

FIGS. 2A, 2B, and 2C show example types of zone players. Zone players 200, 202, and 204 of FIGS. 2A, 2B, and 2C, respectively, can correspond to any of the zone players 102-124 of FIG. 1, for example. In some embodiments, audio is reproduced using only a single zone player, such as by a full-range player. In some embodiments, audio is reproduced using two or more zone players, such as by using a combination of full-range players or a combination of full-range and specialized players. In some embodiments, zone players 200-204 may also be referred to as a "smart speaker," because they contain processing capabilities beyond the reproduction of audio, more of which is described below.

FIG. 2A illustrates zone player 200 that includes sound producing equipment 208 capable of reproducing full-range sound. The sound may come from an audio signal that is received and processed by zone player 200 over a wired or wireless data network. Sound producing equipment 208 includes one or more built-in amplifiers and one or more acoustic transducers (e.g., speakers). A built-in amplifier is described more below with respect to FIG. 4. A speaker or acoustic transducer can include, for example, any of a tweeter, a mid-range driver, a low-range driver, and a subwoofer. In some embodiments, zone player 200 can be statically or dynamically configured to play stereophonic audio, monaural audio, or both. In some embodiments, zone player 200 may be dynamically configured to reproduce a subset of full-range sound, such as when zone player 200 is grouped with other zone players to play stereophonic audio, monaural audio, and/or surround audio or when the audio content received by zone player 200 is less than full-range.

FIG. 2B illustrates zone player 202 that includes a built-in amplifier to power a set of detached speakers 210. A detached speaker can include, for example, any type of loudspeaker. Zone player 202 may be configured to power one, two, or more separate loudspeakers. Zone player 202 may be configured to communicate an audio signal (e.g., right and left channel audio or more channels depending on its configuration) to the detached speakers 210 via a wired path.

FIG. 2C illustrates zone player 204 that does not include a built-in amplifier, but is configured to communicate an audio signal, received over a data network, to an audio (or "audio/video") receiver 214 with built-in amplification.

Referring back to FIG. 1, in some embodiments, one, some, or all of the zone players 102 to 124 can retrieve audio directly from a source. For example, a particular zone player in a zone or zone group may be assigned to a playback queue (or "queue"). The playback queue contains information corresponding to zero or more audio items for playback by the associated zone or zone group. The playback queue may be stored in memory on a zone player or some other designated device. Each item contained in the playback queue may comprise a uniform resource identifier (URI) or some other identifier that can be used by the zone player(s) to seek out and/or retrieve the audio items from the identified audio source(s). Depending on the item, the audio source might be found on the Internet (e.g., the cloud), locally from another device over the data network 128 (described further below), from the controller 130, stored on the zone player itself, or from an audio source communicating directly to the zone player. In some embodiments, the zone player can reproduce the audio itself (e.g., play the audio), send the audio to another zone player for reproduction, or both where the audio is reproduced by the zone player as well as one or more additional zone players (possibly in synchrony). In some embodiments, the zone player may play a first audio content (or alternatively, may not play the content at all), while sending a second, different audio content to another zone player(s) for reproduction. To the user, each item in a playback queue is represented on an interface of a controller by an element such as a track name, album name, playlist, or other some other representation. A user can populate the playback queue with audio items of interest. The user may also modify and clear the playback queue, if so desired.

By way of illustration, SONOS, Inc. of Santa Barbara, Calif. presently offers for sale zone players referred to as a "PLAY:5," "PLAY:3," "PLAYBAR," "CONNECT:AMP," "CONNECT," and "SUB." Any other past, present, and/or future zone players can additionally or alternatively be used to implement the zone players of example embodiments disclosed herein. Additionally, it is understood that a zone player is not limited to the particular examples illustrated in FIGS. 2A, 2B, and 2C or to the SONOS product offerings. For example, a zone player may include a wired or wireless headphone. In yet another example, a zone player might include a sound bar for television. In yet another example, a zone player may include or interact with a docking station for an Apple IPOD™ or similar device.

b. Example Controllers

Figure 3:
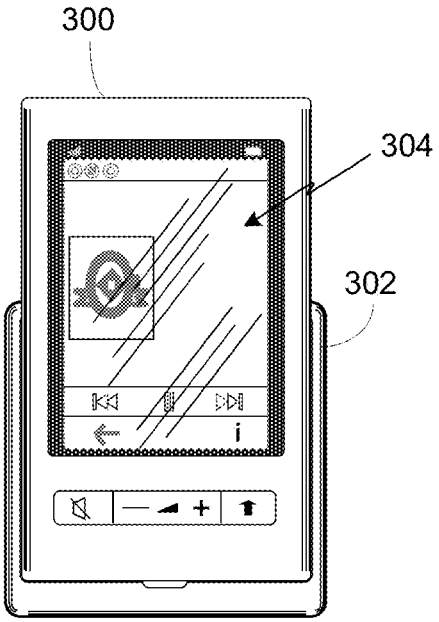
FIG. 3 shows an illustration of an example controller.

FIG. 3 illustrates an example wireless controller 300 in docking station 302. By way of illustration, controller 300 may correspond to controlling device 130 of FIG. 1. Docking station 302, if provided or used, may provide power to the controller 300 and additionally may charge a battery of controller 300. In some embodiments, controller 300 may be provided with a touch screen 304 that allows a user to interact through touch with the controller 300, for example, to retrieve and navigate a playlist of audio items, control operations of one or more zone players, and provide overall control of the system configuration 100. In other embodiments, other input mechanisms such as voice control may be used to interact with the controller 300. In certain embodiments, any number of controllers can be used to control the system configuration 100. In some embodiments, there may be a limit set on the number of controllers that can control the system configuration 100. The controllers might be wireless like wireless controller 300 or wired to data network 128.

In some embodiments, if more than one controller is used in system 100 of FIG. 1, each controller may be coordinated to display common content, and may all be dynamically updated to indicate changes made to the system 100 from a single controller. Coordination can occur, for instance, by a controller periodically requesting a state variable directly or indirectly from one or more of the zone players; the state variable may provide information about system 100, such as current zone group configuration, what is playing in one or more zones, volume levels, and other items of interest. The state variable may be passed around on data network 128 between zone players (and controllers, if so desired) as needed or as often as programmed.

In addition, an application running on any network-enabled portable device, such as an IPHONE™, IPAD™, ANDROID™ powered phone or tablet, or any other smart phone or network-enabled device can be used as controller 130. An application running on a laptop or desktop personal computer (PC) or Mac™ can also be used as controller 130. Such controllers may connect to system 100 through an interface with data network 128, a zone player, a wireless router, or using some other configured connection path. Example controllers offered by Sonos, Inc. of Santa Barbara, Calif. include a "Controller 200," "SONOS® CONTROL," "SONOS® Controller for IPHONE™," "SONOS® Controller for IPAD™," "SONOS® Controller for ANDROID™," "SONOS® Controller for MAC™ or PC."

c. Example Data Connection

Zone players 102 to 124 of FIG. 1 are coupled directly or indirectly to a data network, such as data network 128. Controller 130 may also be coupled directly or indirectly to data network 128 or individual zone players. Data network 128 is represented by an octagon in the figure to stand out from other representative components. While data network 128 is shown in a single location, it is understood that such a network is distributed in and around system 100. Particularly, data network 128 can be a wired network, a wireless network, or a combination of both wired and wireless networks. In some embodiments, one or more of the zone players 102-124 are wirelessly coupled to data network 128 based on a proprietary mesh network. In some embodiments, one or more of the zone players are coupled to data network 128 using a centralized access point such as a wired or wireless router. In some embodiments, one or more of the zone players 102-124 are coupled via a wire to data network 128 using Ethernet or similar technology. In addition to the one or more zone players 102-124 connecting to data network 128, data network 128 can further allow access to a wide area network, such as the Internet.

In some embodiments, connecting any of the zone players 102-124, or some other connecting device, to a broadband router, can create data network 128. Other zone players 102-124 can then be added wired or wirelessly to the data network 128. For example, a zone player (e.g., any of zone players 102-124) can be added to the system configuration 100 by simply pressing a button on the zone player itself (or perform some other action), which enables a connection to be made to data network 128. The broadband router can be connected to an Internet Service Provider (ISP), for example. The broadband router can be used to form another data network within the system configuration 100, which can be used in other applications (e.g., web surfing). Data network 128 can also be used in other applications, if so programmed. An example, second network may implement SONOSNET™ protocol, developed by SONOS, Inc. of Santa Barbara. SONOSNET™ represents a secure, AES-encrypted, peer-to-peer wireless mesh network. Alternatively, in certain embodiments, the data network 128 is the same network, such as a traditional wired or wireless network, used for other applications in the household.

d. Example Zone Configurations

A particular zone can contain one or more zone players. For example, the family room of FIG. 1 contains two zone players 106 and 108, while the kitchen is shown with one zone player 102. In another example, the home theater room contains additional zone players to play audio from a 5.1 channel or greater audio source (e.g., a movie encoded with 5.1 or greater audio channels). In some embodiments, one can position a zone player in a room or space and assign the zone player to a new or existing zone via controller 130. As such, zones may be created, combined with another zone, removed, and given a specific name (e.g., "Kitchen"), if so desired and programmed to do so with controller 130. Moreover, in some embodiments, zone configurations may be dynamically changed even after being configured using controller 130 or some other mechanism.

In some embodiments, a "bonded zone" contains two or more zone players, such as the two zone players 106 and 108 in the family room, whereby the two zone players 106 and 108 can be configured to play the same audio source in synchrony. In one example, the two zone players 106 and 108 can be paired to play two separate sounds in left and right channels, for example. In other words, the stereo effects of a sound can be reproduced or enhanced through the two zone players 106 and 108, one for the left sound and the other for the right sound. In another example two or more zone players can be sonically consolidated to form a single, consolidated zone player. A consolidated zone player (though made up of multiple, separate devices) can be configured to process and reproduce sound differently than an unconsolidated zone player or zone players that are paired, because a consolidated zone player has additional speaker drivers from which sound can be passed. The consolidated zone player can further be paired with a single zone player or yet another consolidated zone player. Each playback device of a consolidated playback device can be set in a consolidated mode, for example.

In certain embodiments, paired or consolidated zone players (also referred to as "bonded zone players") can play audio in synchrony with other zone players in the same or different zones.

According to some embodiments, one can continue to do any of: group, consolidate, and pair zone players, for example, until a desired configuration is complete. The actions of grouping, consolidation, and pairing are preferably performed through a control interface, such as using controller 130, and not by physically connecting and re-connecting speaker wire, for example, to individual, discrete speakers to create different configurations. As such, certain embodiments described herein provide a more flexible and dynamic platform through which sound reproduction can be offered to the end-user.

e. Example Audio Sources

In some embodiments, each zone can play from the same audio source as another zone or each zone can play from a different audio source. For example, someone can be grilling on the patio and listening to jazz music via zone player 124, while someone is preparing food in the kitchen and listening to classical music via zone player 102. Further, someone can be in the office listening to the same jazz music via zone player 110 that is playing on the patio via zone player 124. In some embodiments, the jazz music played via zone players 110 and 124 is played in synchrony. Synchronizing playback amongst zones allows for someone to pass through zones while seamlessly (or substantially seamlessly) listening to the audio. Further, zones can be put into a "party mode" such that all associated zones will play audio in synchrony.

Sources of audio content to be played by zone players 102-124 are numerous. In some embodiments, audio on a zone player itself may be accessed and played. In some embodiments, audio on a controller may be accessed via the data network 128 and played. In some embodiments, music from a personal library stored on a computer or networked-attached storage (NAS) may be accessed via the data network 128 and played. In some embodiments, Internet radio stations, shows, and podcasts may be accessed via the data network 128 and played. Music or cloud services that let a user stream and/or download music and audio content may be accessed via the data network 128 and played. Further, music may be obtained from traditional sources, such as a turntable or CD player, via a line-in connection to a zone player, for example. Audio content may also be accessed using a different protocol, such as AIRPLAY™, which is a wireless technology by Apple, Inc., for example. Audio content received from one or more sources can be shared amongst the zone players 102 to 124 via data network 128 and/or controller 130. The above-disclosed sources of audio content are referred to herein as network-based audio information sources. However, network-based audio information sources are not limited thereto.

In some embodiments, the example home theater zone players 116, 118, 120 are coupled to an audio information source such as a television 132. In some examples, the television 132 is used as a source of audio for the home theater zone players 116, 118, 120, while in other examples audio information from the television 132 may be shared with any of the zone players 102-124 in the audio system 100.

III. Example Zone Players

Figure 4:
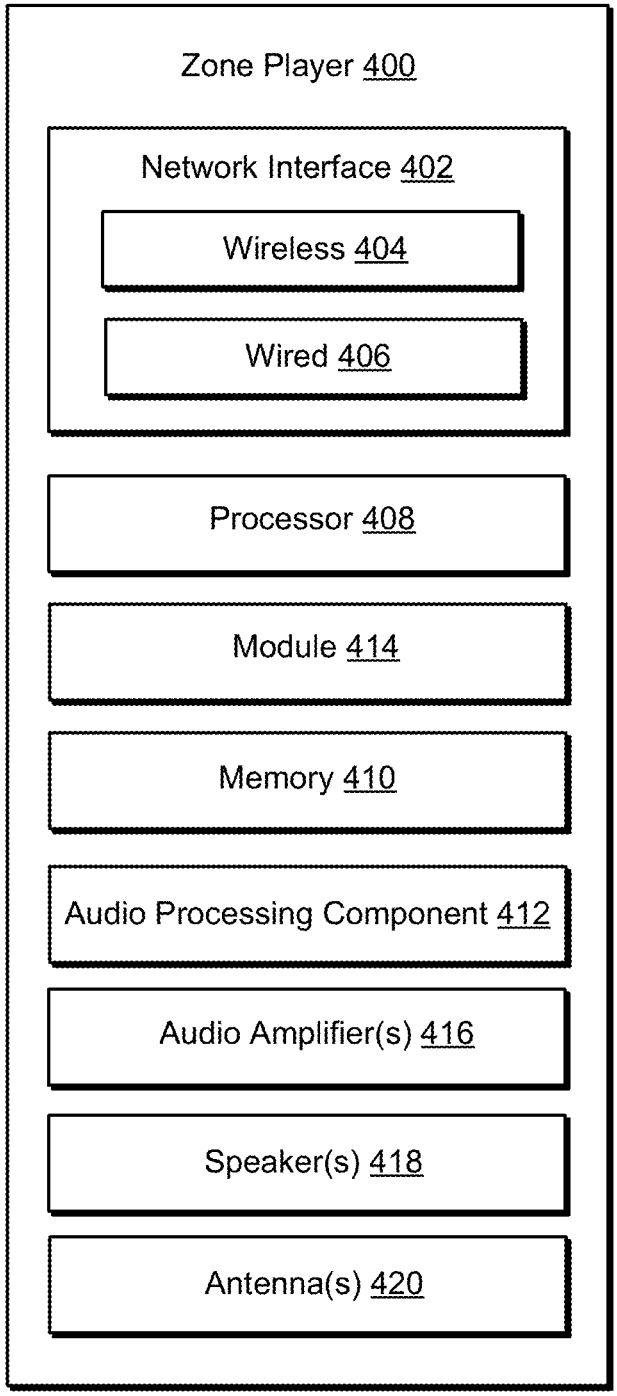
FIG. 4 shows an internal functional block diagram of an example zone player.

Referring now to FIG. 4, there is shown an example block diagram of a zone player 400 in accordance with an embodiment. Zone player 400 includes a network interface 402, a processor 408, a memory 410, an audio processing component 412, one or more modules 414, an audio amplifier 416, and a speaker unit 418 coupled to the audio amplifier 416. FIG. 2A shows an example illustration of such a zone player. Other types of zone players may not include the speaker unit 418 (e.g., such as shown in FIG. 2B) or the audio amplifier 416 (e.g., such as shown in FIG. 2C). Further, it is contemplated that the zone player 400 can be integrated into another component. For example, the zone player 400 could be constructed as part of a television, lighting, or some other device for indoor or outdoor use.

In some embodiments, network interface 402 facilitates a data flow between zone player 400 and other devices on a data network 128. In some embodiments, in addition to getting audio from another zone player or device on data network 128, zone player 400 may access audio directly from the audio source, such as over a wide area network or on the local network. In some embodiments, the network interface 402 can further handle the address part of each packet so that it gets to the right destination or intercepts packets destined for the zone player 400. Accordingly, in certain embodiments, each of the packets includes an Internet Protocol (IP)-based source address as well as an IP-based destination address.

In some embodiments, network interface 402 can include one or both of a wireless interface 404 and a wired interface 406. The wireless interface 404, also referred to as a radio frequency (RF) interface, provides network interface functions for the zone player 400 to wirelessly communicate with other devices (e.g., other zone player(s), speaker(s), receiver (s), component(s) associated with the data network 128, and so on) in accordance with a communication protocol (e.g., any wireless standard including IEEE 802.11a, 802.11b, 802.11g, 802.11n, 802.15, 4G mobile communication standard, and so on). Wireless interface 404 may include one or more radios. To receive wireless signals and to provide the wireless signals to the wireless interface 404 and to transmit wireless signals, the zone player 400 includes one or more antennas 420. The wired interface 406 provides network interface functions for the zone player 400 to communicate over a wire with other devices in accordance with a communication protocol (e.g., IEEE 802.3). In some embodiments, a zone player includes multiple wireless 404 interfaces. In some embodiments, a zone player includes multiple wired 406 interfaces. In some embodiments, a zone player includes both of the interfaces 404 and 406. In some embodiments, a zone player 400 includes only the wireless interface 404 or the wired interface 406.

In some embodiments, the processor 408 is a clock-driven electronic device that is configured to process input data according to instructions stored in memory 410. The memory 410 is data storage that can be loaded with one or more software module(s) 414, which can be executed by the processor 408 to achieve certain tasks. In the illustrated embodiment, the memory 410 is a tangible machine-readable medium storing instructions that can be executed by the processor 408. In some embodiments, a task might be for the zone player 400 to retrieve audio data from another zone player or a device on a network (e.g., using a uniform resource locator (URL) or some other identifier). In some embodiments, a task may be for the zone player 400 to send audio data to another zone player or device on a network. In some embodiments, a task may be for the zone player 400 to synchronize playback of audio with one or more additional zone players. In some embodiments, a task may be to pair the zone player 400 with one or more zone players to create a multichannel audio environment. Additional or alternative tasks can be achieved via the one or more software module(s) 414 and the processor 408.

In some embodiments, the memory 410 can include a primary flag 422. The primary flag 422 indicates whether a zone player (e.g., the zone player 400) is a primary playback device or a secondary playback device. For example, a first primary flag 422 value (e.g., the primary flag 422 is set, a positive value, a yes, a "1," etc.) may indicate the zone player 400 is a primary playback device while a secondary primary flag 422 value (e.g., the primary flag 422 is cleared, a negative value, a no, a "0," etc.) may indicate the zone player 400 is a secondary playback device. In some embodiments, a primary playback device is elected (e.g., selected, designated, etc.) from a group of playback devices (e.g., a bonded zone, a zone group), while other playback devices in the bonded zone act in the role of secondary devices. In some such embodiment, the primary playback device can have unidirectional control over the secondary playback devices. Thus, in some embodiments, the memory 410 may include a primary flag. The primary flag can indicate whether a zone player acts as a primary playback device or as a secondary playback device.

The audio processing component 412 can include one or more digital-to-analog converters (DAC), an audio preprocessing component, an audio enhancement component or a digital signal processor, and so on. In some embodiments, the audio processing component 412 may be part of processor 408. In some embodiments, the audio that is retrieved via the network interface 402 is processed and/or intentionally altered by the audio processing component 412. Further, the audio processing component 412 can produce analog audio signals. The processed analog audio signals are then provided to the audio amplifier 416 for playback through speakers 418. In addition, the audio processing component 412 can include circuitry to process analog or digital signals as inputs to play from zone player 400, send to another zone player on a network, or both play and send to another zone player on the network. An example input includes a line-in connection (e.g., an auto-detecting 3.5 mm audio line-in connection).

In some embodiments, the zone player 400 can include a volume modifier 424. In some embodiments, the volume modifier 424 may be included in the processor 408 and/or the audio processing component 412. In some embodiments, the volume modifier 424 receives an information packet including user input. For example, a user may select to adjust (e.g., increase or decrease) the volume of a zone player. In some such embodiments, the change in volume can be included in an information packet. In some embodiments, a user may select to adjust the gain of a playback device. The gain of a playback is a multiplier that determines how much audio output can be expected from the playback device for a given input signal amplifier. In some embodiments, this gain (or level) can be determined as a ratio of the output voltage between speaker terminals of the playback device to the input voltage to the amplifier of the playback device. In some embodiments, the information packet is obtained via a user interface associated with (e.g., included in, coupled with, etc.) the playback device. In some embodiments, the information packet is obtained via the network interface 402. For example, a user can adjust the volume for a first playback device by selecting a desired volume change via a controller (e.g., the example controller 300 of FIG. 3) and/or a user interface included with a second playback device. In some embodiments, the volume modifier 424 processes and/or intentionally alters the audio that is retrieved via the network interface 402 based on the obtained information packet (e.g., a volume change). The volume modifier 424 can then provide the volume adjusted audio signal to the audio processing component 412 for further processing and/or the audio amplifier 416 for playback through a speaker(s) 418.

In some embodiments, the volume may be adjusted directly by the amplifier. For example, the audio amplifier 416 may adjust the audio volume directly by changing the audio gain based on volume information (e.g., a gain value) included in the information packet.

In some examples, the volume modifier 424 may determine how to adjust audio for playback in a bonded zone. For example, the primary playback device may store what playback devices are included in the bonded zone and the playback characteristics of the playback devices. Thus, in some examples, the primary playback device is able to "personalize" audio for playback for each playback device. That is, each playback device in the bonded zone may receive audio adjusted for playback that is optimized for the respective playback device. In some examples, the primary playback device may receive an indication to increase the volume. However, the audio volume may be set for the entire bonded zone. Thus, when adjusting the audio for each playback device, the audio adjustments for each playback may be different to enable the group increase in volume. That is, even though a volume up was input at a secondary playback device, to effectuate the volume up request for the bonded zone audio, the secondary playback device may not increase in volume. Rather, other playback devices in the bonded zone may playback adjusted audio accordingly.

The audio amplifier 416 is a device(s) that amplifies audio signals to a level for driving one or more speakers 418. The one or more speakers 418 can include an individual transducer (e.g., a "driver") or a complete speaker system that includes an enclosure including one or more drivers. A particular driver can be a subwoofer (e.g., for low frequencies), a mid-range driver (e.g., for middle frequencies), and a tweeter (e.g., for high frequencies), for example. An enclosure can be sealed or ported, for example. Each transducer may be driven by its own individual amplifier.

A commercial example, presently known as the PLAY:5™, is a zone player with a built-in amplifier and speakers that is capable of retrieving audio directly from the source, such as on the Internet or on the local network, for example. In particular, the PLAY:5™ is a five-amp, five-driver speaker system that includes two tweeters, two mid-range drivers, and one woofer. When playing audio content via the PLAY:5™, the left audio data of a track is sent out of the left tweeter and left mid-range driver, the right audio data of a track is sent out of the right tweeter and the right mid-range driver, and mono bass is sent out of the subwoofer. Further, both mid-range drivers and both tweeters have the same equalization (or substantially the same equalization). That is, they are both sent the same frequencies but from different channels of audio. Audio from Internet radio stations, online music and video services, downloaded music, analog audio inputs, television, DVD, and so on, can be played from the PLAY:5™.

IV. Example Controller

Figure 5:
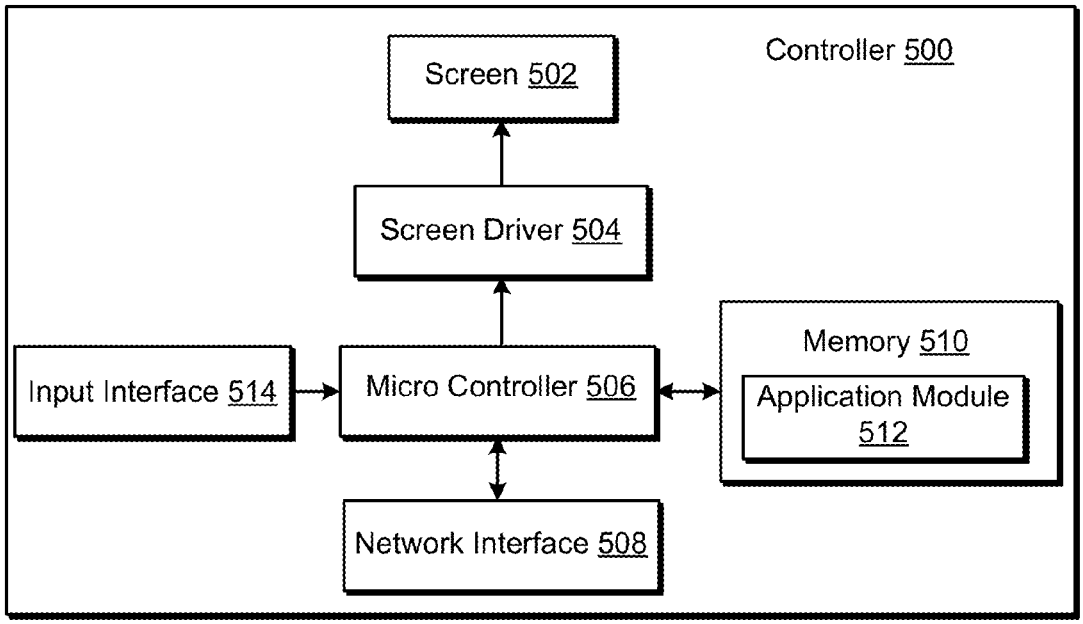
FIG. 5 shows an internal functional block diagram of an example controller.

Referring now to FIG. 5, there is shown an example block diagram for controller 500, which can correspond to the controlling device 130 in FIG. 1. Controller 500 can be used to facilitate the control of multi-media applications, automation and others in a system. In particular, the controller 500 may be configured to facilitate a selection of a plurality of audio sources available on the network and enable control of one or more zone players (e.g., the zone players 102-124 in FIG. 1) through a wireless or wired network interface 508. According to one embodiment, the wireless communications is based on an industry standard (e.g., infrared, radio, wireless standards including IEEE 802.11a, 802.11b, 802.11g, 802.11n, 802.15, 4G mobile communication standard, and so on). Further, when a particular audio is being accessed via the controller 500 or being played via a zone player, a picture (e.g., album art) or any other data, associated with the audio and/or audio source can be transmitted from a zone player or other electronic device to controller 500 for display.

Controller 500 is provided with a screen 502 and an input interface 514 that allows a user to interact with the controller 500, for example, to navigate a playlist of many multimedia items and to control operations of one or more zone players. The screen 502 on the controller 500 can be an LCD screen, for example. The screen 500 communicates with and is commanded by a screen driver 504 that is controlled by a microcontroller (e.g., a processor) 506. The memory 510 can be loaded with one or more application modules 512 that can be executed by the microcontroller 506 with or without a user input via the user interface 514 to achieve certain tasks. In some embodiments, an application module 512 is configured to facilitate grouping a number of selected zone players into a zone group and synchronizing the zone players for audio playback. In some embodiments, an application module 512 is configured to control the audio sounds (e.g., volume) of the zone players in a zone group. In operation, when the microcontroller 506 executes one or more of the application modules 512, the screen driver 504 generates control signals to drive the screen 502 to display an application specific user interface accordingly.

The controller 500 includes a network interface 508 that facilitates wired or wireless communication with a zone player. In some embodiments, the commands such as volume control and audio playback synchronization are sent via the network interface 508. In some embodiments, a saved zone group configuration is transmitted between a zone player and a controller via the network interface 508. The controller 500 can control one or more zone players, such as 102-124 of FIG. 1. There can be more than one controller for a particular system, and each controller may share common information with another controller, or retrieve the common information from a zone player, if such a zone player stores configuration data (e.g., such as a state variable). Further, a controller can be integrated into a zone player.

It should be noted that other network-enabled devices such as an IPHONE™, IPAD™ or any other smart phone or network-enabled device (e.g., a networked computer such as a PC or MAC™) can also be used as a controller to interact or control zone players in a particular environment. In some embodiments, a software application or upgrade can be downloaded onto a network-enabled device to perform the functions described herein.

In certain embodiments, a user can create a zone group (also referred to as a bonded zone) including at least two zone players from the controller 500. The zone players in the zone group can play audio in a synchronized fashion, such that all of the zone players in the zone group playback an identical audio source or a list of identical audio sources in a synchronized manner such that no (or substantially no) audible delays or hiccups are to be heard. Similarly, in some embodiments, when a user increases the audio volume of the group from the controller 500, the signals or data of increasing the audio volume for the group are sent to one of the zone players and causes other zone players in the group to be increased together in volume.

In some embodiments including a bonded zone (e.g., one or more grouped, consolidated and/or paired zone players), one of the zone players may be designated as a primary playback device, while the remaining zone player(s) may be designated as a secondary (or satellite) playback device(s). In addition, any playback device may be designated a primary playback device for the bonded zone. A primary playback device performs signal processing on multimedia content (e.g., an audio stream, etc.) and sends processed (e.g., filtered) content to each secondary playback device of the zone configuration. For example, a primary playback device in a stereo pair may receive an audio stream and separate (e.g., process) the left channel and the right channel of the audio stream for playback. In some such embodiments, if the primary playback device is tasked with playback of the left channel audio, then the primary playback device of the bonded zone sends (e.g., transmits, communicates, etc.) the right channel audio to the secondary playback device for playback. In some such embodiments, the primary playback device adjusts the sound (e.g., balance, volume levels and/or timing delays) of the audio signal and sends the adjusted audio signal(s) to the secondary playback device(s).

A user via the controller 500 can group zone players into a zone group by activating a "Link Zones" or "Add Zone" soft button, or de-grouping a zone group by activating an "Unlink Zones" or "Drop Zone" button. For example, one mechanism for 'joining' zone players together for audio playback is to link a number of zone players together to form a group. To link a number of zone players together, a user can manually link each zone player or room one after the other. For example, assume that there is a multi-zone system that includes the following zones: Bathroom, Bedroom, Den, Dining Room, Family Room, and Foyer.

In certain embodiments, a user can link any number of the six zone players, for example, by starting with a single zone and then manually linking each zone to that zone.

In certain embodiments, a set of zones can be dynamically linked together using a command to create a zone scene or theme (subsequent to first creating the zone scene). For instance, a "Morning" zone scene command can link the Bedroom, Office, and Kitchen zones together in one action. Without this single command, the user would manually and individually link each zone. The single command may include a mouse click, a double mouse click, a button press, a gesture, or some other programmed or learned action. Other kinds of zone scenes can be programmed or learned by the system over time.

In certain embodiments, a zone scene can be triggered based on time (e.g., an alarm clock function). For instance, a zone scene can be set to apply at 8:00 am. The system can link appropriate zones automatically, set specific music to play, and then stop the music after a defined duration. Although any particular zone can be triggered to an "On" or "Off" state based on time, for example, a zone scene enables any zone(s) linked to the scene to play a predefined audio (e.g., a favorable song, a predefined playlist) at a specific time and/or for a specific duration. If, for any reason, the scheduled music failed to be played (e.g., an empty playlist, no connection to a share, failed Universal Plug and Play (UPnP), no Internet connection for an Internet Radio station, and so on), a backup buzzer can be programmed to sound. The buzzer can include a sound file that is stored in a zone player, for example.

V. Playback Queue

As discussed above, in some embodiments, a zone player may be assigned to a playback queue identifying zero or more media items for playback by the zone player. The media items identified in a playback queue may be represented to the user via an interface on a controller. For instance, the representation may show the user (or users if more than one controller is connected to the system) how the zone player is traversing the playback queue, such as by highlighting the "now playing" item, graying out the previously played item(s), highlighting the to-be-played item(s), and so on.

In some embodiments, a single zone player is assigned to or otherwise associated with a playback queue. For example, zone player 114 in the bathroom of FIG. 1 may be linked or assigned to a "Bathroom" playback queue. In an embodiment, the "Bathroom" playback queue might have been established by the system as a result of the user naming the zone player 114 to the bathroom. As such, contents populated and identified in the "Bathroom" playback queue can be played via the zone player 114 (the bathroom zone).

In some embodiments, a zone or zone group is assigned to a playback queue. For example, zone players 106 and 108 in the family room of FIG. 1 may be linked or assigned to a "Family room" playback queue. In another example, if family room and dining room zones were grouped, then the new group would be linked or assigned to a "family room+dining room" playback queue. In some embodiments, the family room+dining room playback queue would be established based upon the creation of the group. In some embodiments, upon establishment of the new group, the family room+dining room playback queue can automatically include the contents of one (or both) of the playback queues associated with either the family room or dining room or both. In one instance, if the user started with the family room and added the dining room, then the contents of the family room playback queue would become the contents of the family room+dining room playback queue. In another instance, if the user started with the family room and added the dining room, then the family room playback queue would be renamed to the family room+dining room playback queue. If the new group was "ungrouped," then the family room+dining room playback queue may be removed from the system and/or renamed to one of the zones (e.g., renamed to "family room" or "dining room"). After ungrouping, each of the family room and the dining room will be assigned to a separate playback queue. One or more of the zone players in the zone or zone group may store in memory the associated playback queue.

As such, when zones or zone groups are "grouped" or "ungrouped" dynamically by the user via a controller, the system will, in some embodiments, establish or remove/rename playback queues respectively, as each zone or zone group is to be assigned to a playback queue. In other words, the playback queue operates as a container that can be populated with media items for playback by the assigned zone. In some embodiments, the media items identified in a playback queue can be manipulated (e.g., re-arranged, added to, deleted from, and so on).

Figure 6:
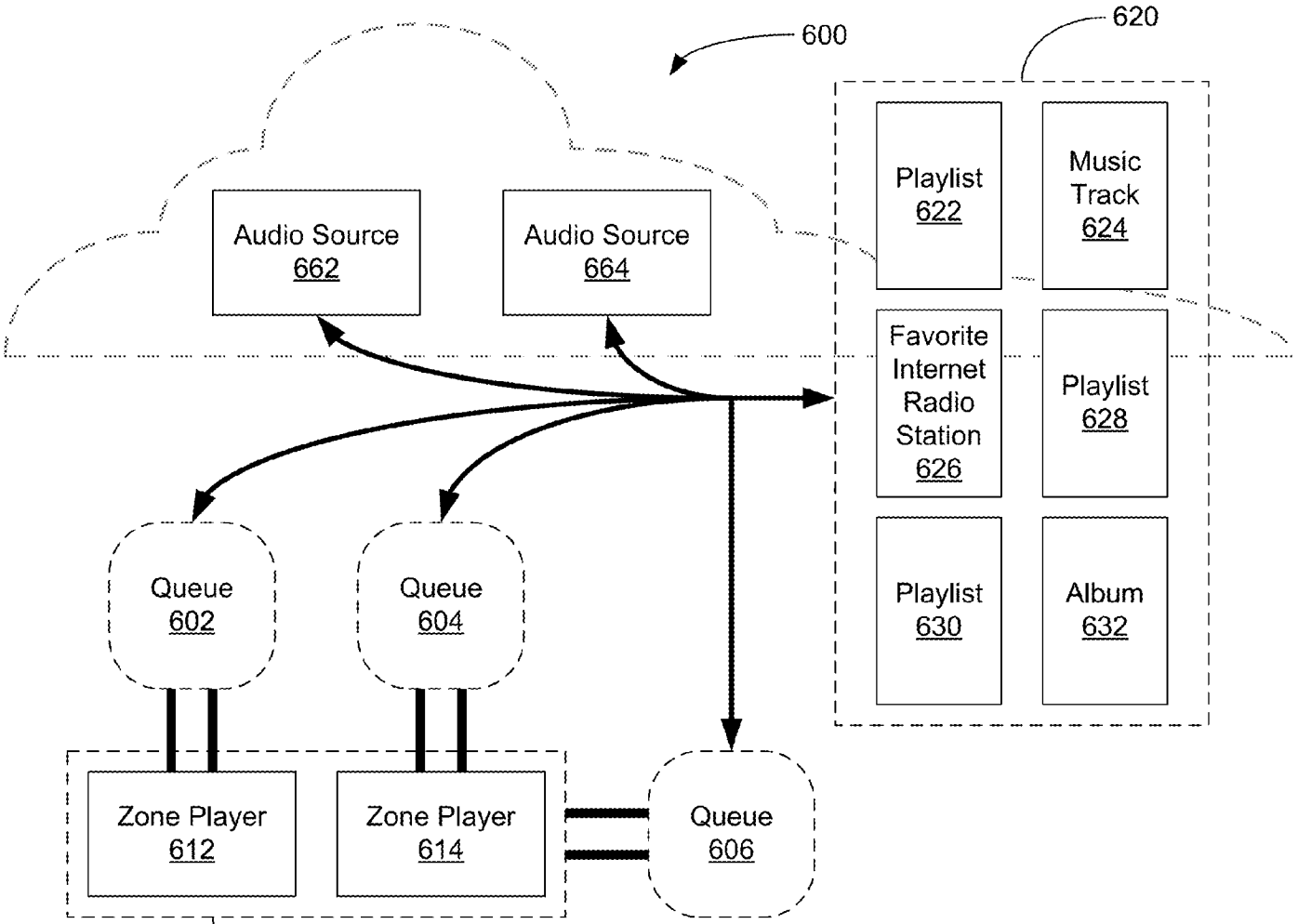
FIG. 6 shows an example network for media content playback.

By way of illustration, FIG. 6 shows an example network 600 for media content playback. As shown, the example network 600 includes example zone players 612 and 614, example audio sources 662 and 664, and example media items 620. The example media items 620 may include playlist 622, music track 624, favorite Internet radio station 626, playlists 628 and 630, and album 632. In one embodiment, the zone players 612 and 614 may be any of the zone players shown in FIGS. 1, 2, and 4. For instance, zone players 612 and 614 may be the zone players 106 and 108 in the Family Room.

In one example, the example audio sources 662 and 664, and example media items 620 may be partially stored on a cloud network, discussed more below in connection to FIG. 8. In some cases, the portions of the audio sources 662, 664, and example media items 620 may be stored locally on one or both of the zone players 612 and 614. In one embodiment, playlist 622, favorite Internet radio station 626, and playlist 630 may be stored locally, and music track 624, playlist 628, and album 632 may be stored on the cloud network.

Each of the example media items 620 may be a list of media items playable by a zone player(s). In one embodiment, the example media items may be a collection of links or pointers (e.g., URI) to the underlying data for media items that are stored elsewhere, such as the audio sources 662 and 664. In another embodiment, the media items may include pointers to media content stored on the local zone player, another zone player over a local network, or a controller device connected to the local network.

As shown, the example network 600 may also include an example queue 602 associated with the zone player 612, and an example queue 604 associated with the zone player 614. Queue 606 may be associated with a group, when in existence, comprising zone players 612 and 614. Queue 606 might comprise a new queue or exist as a renamed version of queue 602 or 604. In some embodiments, in a group (e.g., a bonded zone or a zone group), the zone players 612 and 614 would be assigned to queue 606 and queue 602 and 604 would not be available at that time. In some embodiments, when the group is no longer in existence, queue 606 is no longer available. Each zone player and each combination of zone players in a network of zone players, such as those shown in FIG. 1 or that of example zone players 612, 614, and example combination 616, may be uniquely assigned to a corresponding playback queue.

A playback queue, such as playback queues 602, 604, 606, may include identification of media content to be played by the corresponding zone player or combination of zone players. As such, media items added to the playback queue are to be played by the corresponding zone player or combination of zone players. The zone player may be configured to play items in the queue according to a specific order (such as an order in which the items were added), in a random order, or in some other order.

The playback queue may include a combination of playlists and other media items added to the queue. In one embodiment, the items in playback queue 602 to be played by the zone player 612 may include items from the audio sources 662, 664, or any of the media items 622, 624, 626, 628, 630, 632. The playback queue 602 may also include items stored locally on the zone player 612, or items accessible from the zone player 614. For instance, the playback queue 602 may include Internet radio 626 and album 632 items from audio source 662, and items stored on the zone player 612.

When a media item is added to the queue via an interface of a controller, a link to the item may be added to the queue. In a case of adding a playlist to the queue, links to the media items in the playlist may be provided to the queue. For example, the playback queue 602 may include pointers from the Internet radio 626 and album 632, pointers to items on the audio source 662, and pointers to items on the zone player 612. In another case, a link to the playlist, for example, rather than a link to the media items in the playlist may be provided to the queue, and the zone player or combination of zone players may play the media items in the playlist by accessing the media items via the playlist. For example, the album 632 may include pointers to items stored on audio source 662. Rather than adding links to the items on audio source 662, a link to the album 632 may be added to the playback queue 602, such that the zone player 612 may play the items on the audio source 662 by accessing the items via pointers in the playlist 632.

In some cases, contents as they exist at a point in time within a playback queue may be stored as a playlist, and subsequently added to the same queue later or added to another queue. For example, contents of the playback queue 602, at a particular point in time, may be saved as a playlist, stored locally on the zone player 612 and/or on the cloud network. The saved playlist may then be added to playback queue 604 to be played by zone player 614.

VI. Example Ad-Hoc Network

Figure 7:
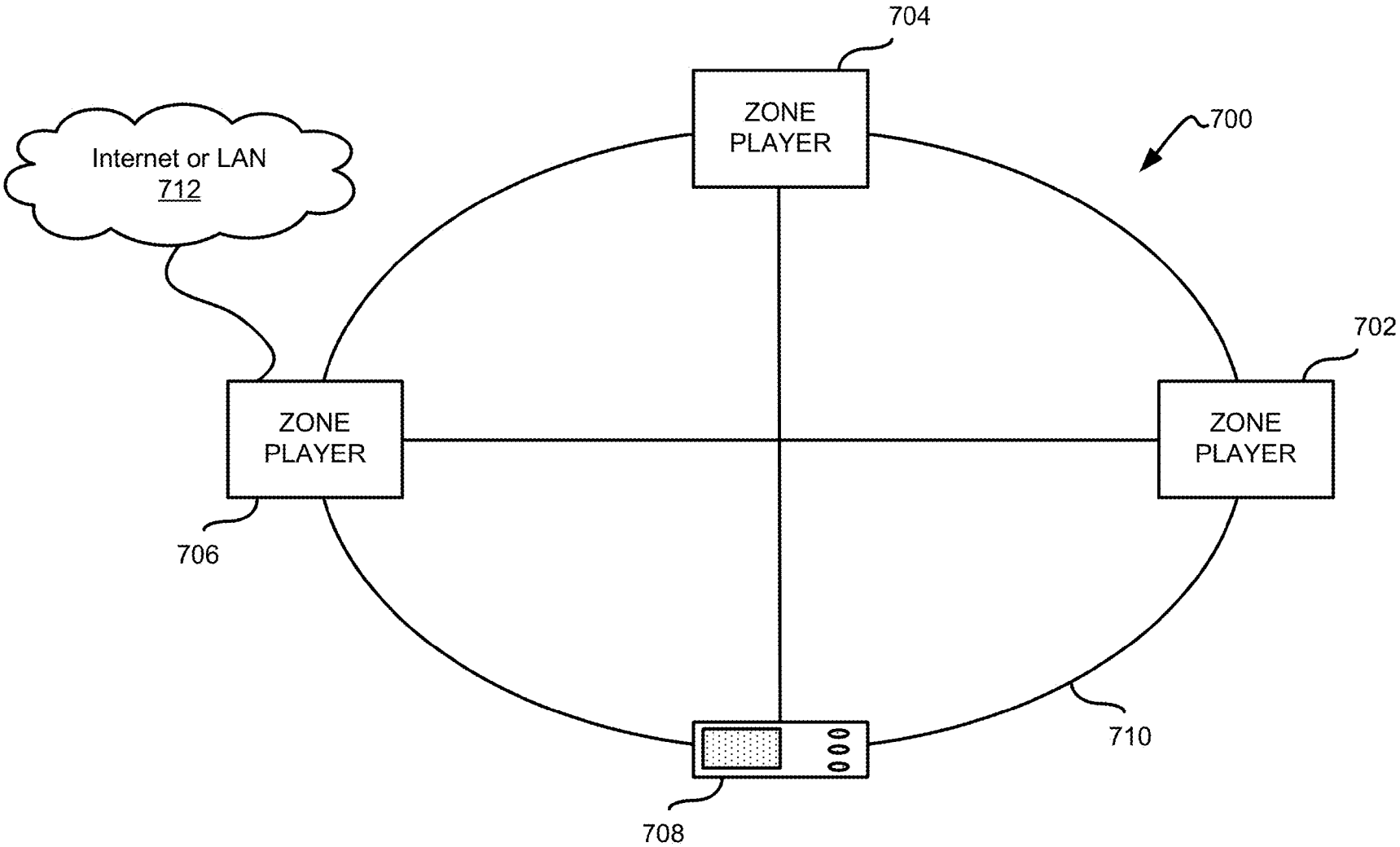
FIG. 7 shows an example ad-hoc playback network.

Particular examples are now provided in connection with FIG. 7 to describe, for purposes of illustration, certain embodiments to provide and facilitate connection to a playback network. FIG. 7 shows that there are three zone players 702, 704 and 706 and a controller 708 that form a network branch that is also referred to as an Ad-Hoc network 710. The network 710 may be wireless, wired, or a combination of wired and wireless technologies. In general, an Ad-Hoc (or "spontaneous") network is a local area network or other small network in which there is generally no one access point for all traffic. With an established Ad-Hoc network 710, the devices 702, 704, 706 and 708 can all communicate with each other in a "peer-to-peer" style of communication, for example. Furthermore, devices may join and/or leave from the network 710, and the network 710 will automatically reconfigure itself without needing the user to reconfigure the network 710. While an Ad-Hoc network is referenced in FIG. 7, it is understood that a playback network may be based on a type of network that is completely or partially different from an Ad-Hoc network.

Using the Ad-Hoc network 710, the devices 702, 704, 706, and 708 can share or exchange one or more audio sources and be dynamically grouped (or ungrouped) to play the same or different audio sources. For example, the devices 702 and 704 are grouped to playback one piece of music, and at the same time, the device 706 plays back another piece of music. In other words, the devices 702, 704, 706 and 708, as shown in FIG. 7, form a HOUSEHOLD that distributes audio and/or reproduces sound. As used herein, the term HOUSEHOLD (provided in uppercase letters to disambiguate from the user's domicile) is used to represent a collection of networked devices that are cooperating to provide an application or service. An instance of a HOUSEHOLD is identified with a household 710 (or household identifier), though a HOUSEHOLD may be identified with a different area or place.

In certain embodiments, a household identifier (HHID) is a short string or an identifier that is computer-generated to help ensure that it is unique. Accordingly, the network 710 can be characterized by a unique HHID and a unique set of configuration variables or parameters, such as channels (e.g., respective frequency bands), service set identifier (SSID) (a sequence of alphanumeric characters as a name of a wireless network), and WEP keys (wired equivalent privacy) or other security keys. In certain embodiments, SSID is set to be the same as HHID.

In certain embodiments, each HOUSEHOLD includes two types of network nodes: a control point (CP) and a zone player (ZP). The control point controls an overall network setup process and sequencing, including an automatic generation of required network parameters (e.g., security keys). In an embodiment, the CP also provides the user with a HOUSEHOLD configuration user interface. The CP function can be provided by a computer running a CP application module, or by a handheld controller (e.g., the controller 708) also running a CP application module, for example. The zone player is any other device on the network that is placed to participate in the automatic configuration process. The ZP, as a notation used herein, includes the controller 708 or a computing device, for example. In some embodiments, the functionality, or certain parts of the functionality, in both the CP and the ZP are combined at a single node (e.g., a ZP contains a CP or vice-versa).

In certain embodiments, configuration of a HOUSEHOLD involves multiple CPs and ZPs that rendezvous and establish a known configuration such that they can use a standard networking protocol (e.g., IP over Wired or Wireless Ethernet) for communication. In an embodiment, two types of networks/protocols are employed: Ethernet 802.3 and Wireless 802.11g. Interconnections between a CP and a ZP can use either of the networks/protocols. A device in the system as a member of a HOUSEHOLD can connect to both networks simultaneously.

In an environment that has both networks in use, it is assumed that at least one device in a system is connected to both as a bridging device, thus providing bridging services between wired/wireless networks for others. The zone player 706 in FIG. 7 is shown to be connected to both networks, for example. The connectivity to the network 712 is based on Ethernet and/or Wireless, while the connectivity to other devices 702, 704 and 708 is based on Wireless and Ethernet if so desired.

It is understood, however, that in some embodiments each zone player 706, 704, 702 may access the Internet when retrieving media from the cloud (e.g., the Internet) via the bridging device. For example, zone player 702 may contain a uniform resource locator (URL) that specifies an address to a particular audio track in the cloud. Using the URL, the zone player 702 may retrieve the audio track from the cloud, and ultimately play the audio out of one or more zone players.

VII. Another Example System Configuration

Figure 8:
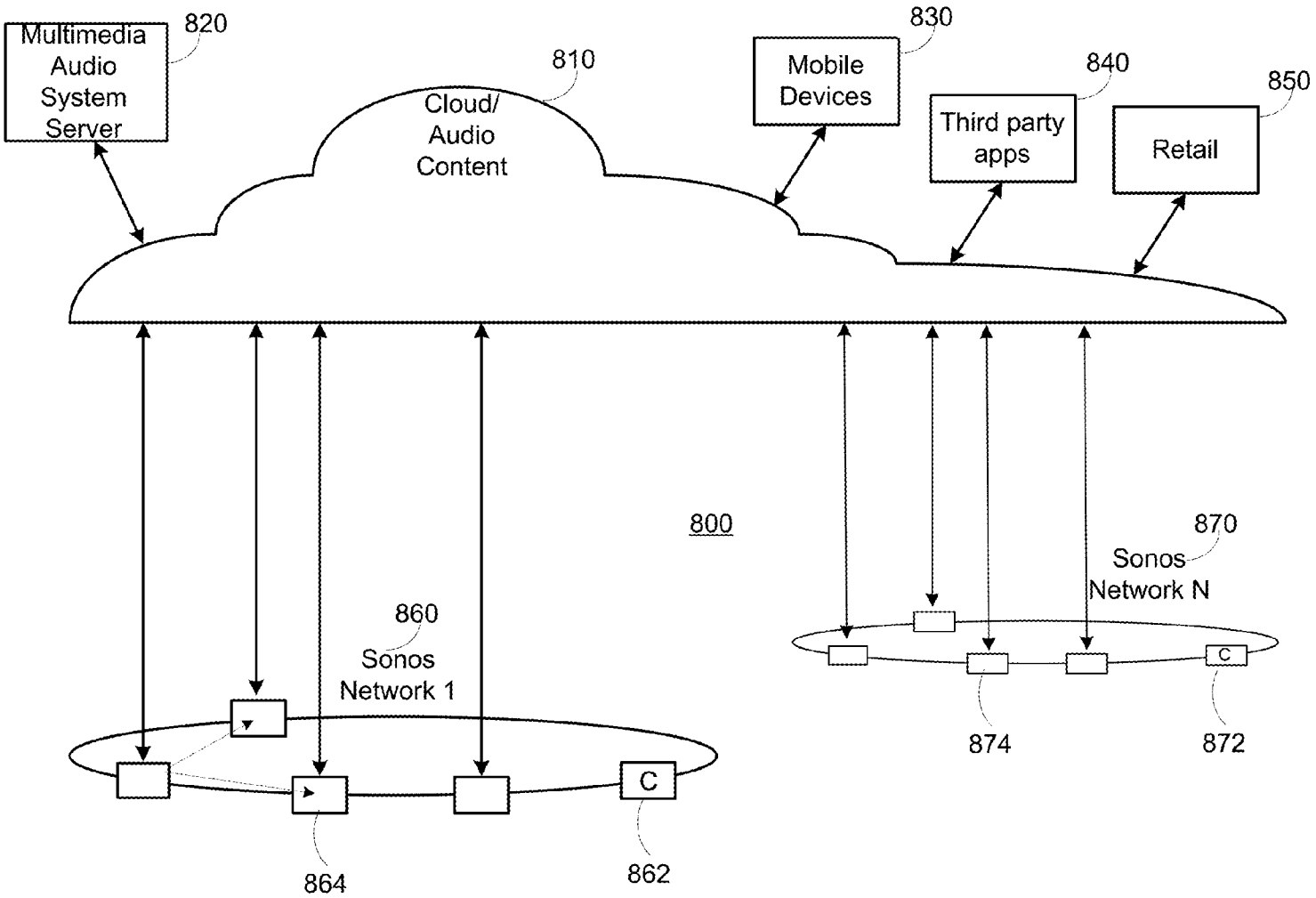
FIG. 8 shows a system including a plurality of networks including a cloud-based network and at least one local playback network.

FIG. 8 shows a system 800 including a plurality of interconnected networks including a cloud-based network and at least one local playback network. A local playback network includes a plurality of playback devices or players, though it is understood that the playback network may contain only one playback device. In certain embodiments, each player has an ability to retrieve its content for playback. Control and content retrieval can be distributed or centralized, for example. Input can include streaming content provider input, third party application input, mobile device input, user input, and/or other playback network input into the cloud for local distribution and playback.

As illustrated by the example system 800 of FIG. 8, a plurality of content providers 820-850 can be connected to one or more local playback networks 860-870 via a cloud and/or other network 810. Using the cloud 810, a multimedia audio system server 820 (e.g., Sonos™), a mobile device 830, a third party application 840, a content provider 850 and so on can provide multimedia content (requested or otherwise) to local playback networks 860, 870. Within each local playback network 860, 870, a controller 862, 872 and a playback device 864, 874 can be used to playback audio content.

VIII. Example Antenna Board

Figure 9:
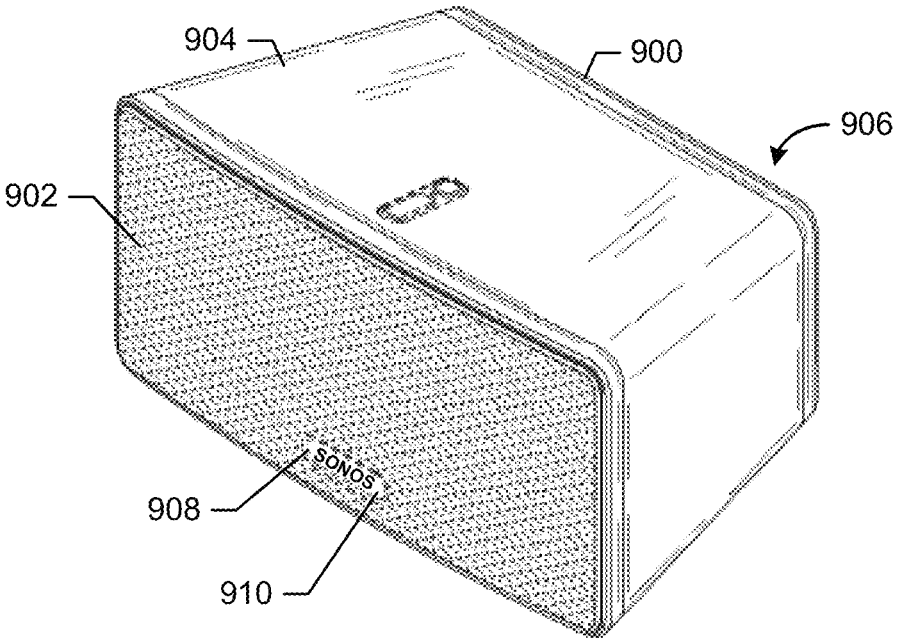
FIG. 9 shows an example playback device in which teachings of this disclosure may be implemented.

FIG. 9 illustrates an example playback device 900 in which examples disclosed herein may be implemented. The example playback device 900 of FIG. 9 may correspond to any of the playback devices (e.g., zone players, speakers, etc.) of FIGS. 1-8. While the following embodiments of the examples disclosed herein are described in connection with the example playback device 900 of FIG. 9, example methods and apparatus for antennas disclosed herein may be implemented in additional or alternative types of devices that communicate wirelessly.

The example playback device 900 of FIG. 9 includes a metallic grill 902 as the front face of a housing 904. The remaining portions or faces 906 of the housing 904 are made from plastic. The playback device 900 may employ the metallic grill 902 for purposes of, for example, durability and/or aesthetics. While the example playback device 900 of FIG. 9 includes a front face made of metal, the present disclosure can be applied to any device of any material including, for example, other high-interference materials similar to metal. Further, while the portions or faces 906 of the housing 904 other than the metal grill 902 of the example playback device 900 of FIG. 9 are made from plastic, those portions can be made from any material including, for example, a material having a lower interference factor than the metallic grill 902.

The example playback device 900 of FIG. 9 includes an opening or aperture 908 in the metallic grill 900. The grill 902 may also include a plurality of smaller (in diameter) holes or perforations that form a pattern across the grill 902 that are typical for grills on a face of a playback device. The example playback device 900 of FIG. 9 includes a plastic cover 910 to cover the opening 908 in the grill 902. In the illustrated example, the mark SONOS is printed on or otherwise incorporated with the plastic cover 910. The plastic cover 910 has a lower interface factor than the metallic grill 902 and, thus, enables internal antenna(s) of the playback device 900 of FIG. 9 to receive and transmit wireless signals from and to a direction in which the metallic grill 902 faces without significant distortion. In other words, the opening 908 provides a pathway through which a wireless signal may be received or transmitted by antenna(s) located inside the housing 904. Example antennas constructed in accordance with teachings of this disclosure, which are described below, may be deployed in connection with the opening 908 and plastic cover 910 of FIG. 9. The example playback device 900 of FIG. 9 includes a plurality of additional antennas positioned, for example, adjacent and/or affixed to inner surfaces of the plastic faces 906 of the housing 904 to enhance the omnidirectional ability of the playback device 900.

Figure 10:
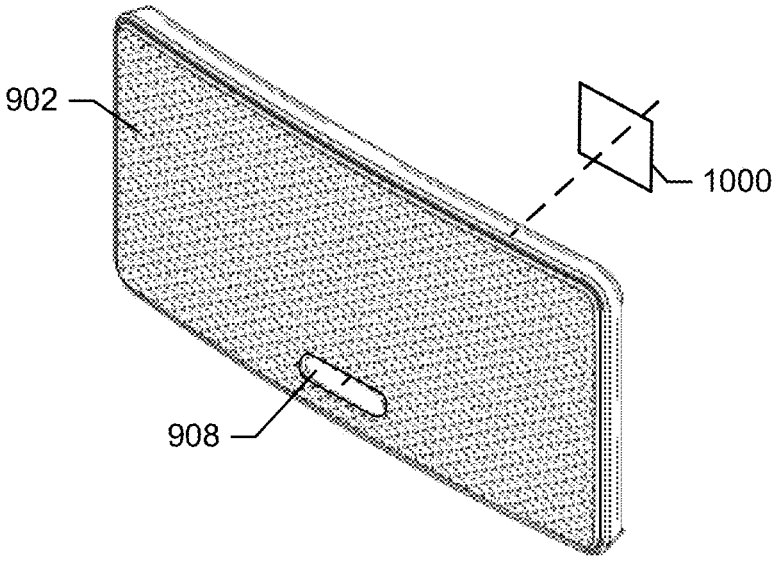
FIG. 10 shows a partially exploded view of the example playback device of FIG. 9.

FIG. 10 shows a partially exploded view of the example playback device 900 of FIG. 9. In particular, FIG. 10 illustrates the metallic grill 902 and the opening 908 in the metallic grill 902. FIG. 10 includes a representation of an example antenna board 1000 constructed in accordance with teachings of this disclosure, which is described in detail below in connection with FIG. 11. In the example of FIG. 10, the example antenna board 1000 is positioned adjacent the opening 908. Put another way, the example antenna board 1000 is positioned behind the cover 910 of FIG. 9. The position of the example antenna board 1000 enables wireless signals to be received and sent through the opening 908. When assembled, the playback device 900 includes the antenna board 1000 located adjacent (e.g., near) an inner surface of the grill 902 and/or affixed to the grill 902 within an inner cavity formed by the housing 904. In particular, the antenna board 1000 is positioned at a certain distance from the inner surface of the grill 902 such that interference from the metal grill 902 and/or detuning of impedance caused by the metal grill 902 is reduced or minimized. This distance can be calculated and implemented using any suitable method, such as a trial and error process, tests, mathematical estimations, etc.

In the example of FIG. 10, the plastic cover 910 behind which the antenna board 1000 is positioned is relatively small. As described below in connection with FIG. 11, the example antenna board 1000 includes slot antennas that radiate through the opening 908. Thus, in the illustrated example, the size of the plastic cover 910 limits the possible size of the antenna board 1000. Moreover, if multiple antennas are desired for the site of the opening 908 to provide additional coverage, placing multiple antennas in such close proximity present challenges due to, for example, performance of the individual antennas being negatively affected by the other antenna(s). Thus, in the illustrated example, if multiple antennas are to be utilized, diversity between the antennas is desirably achieved via, for example, a threshold amount of isolation between the antennas.

Figure 11:
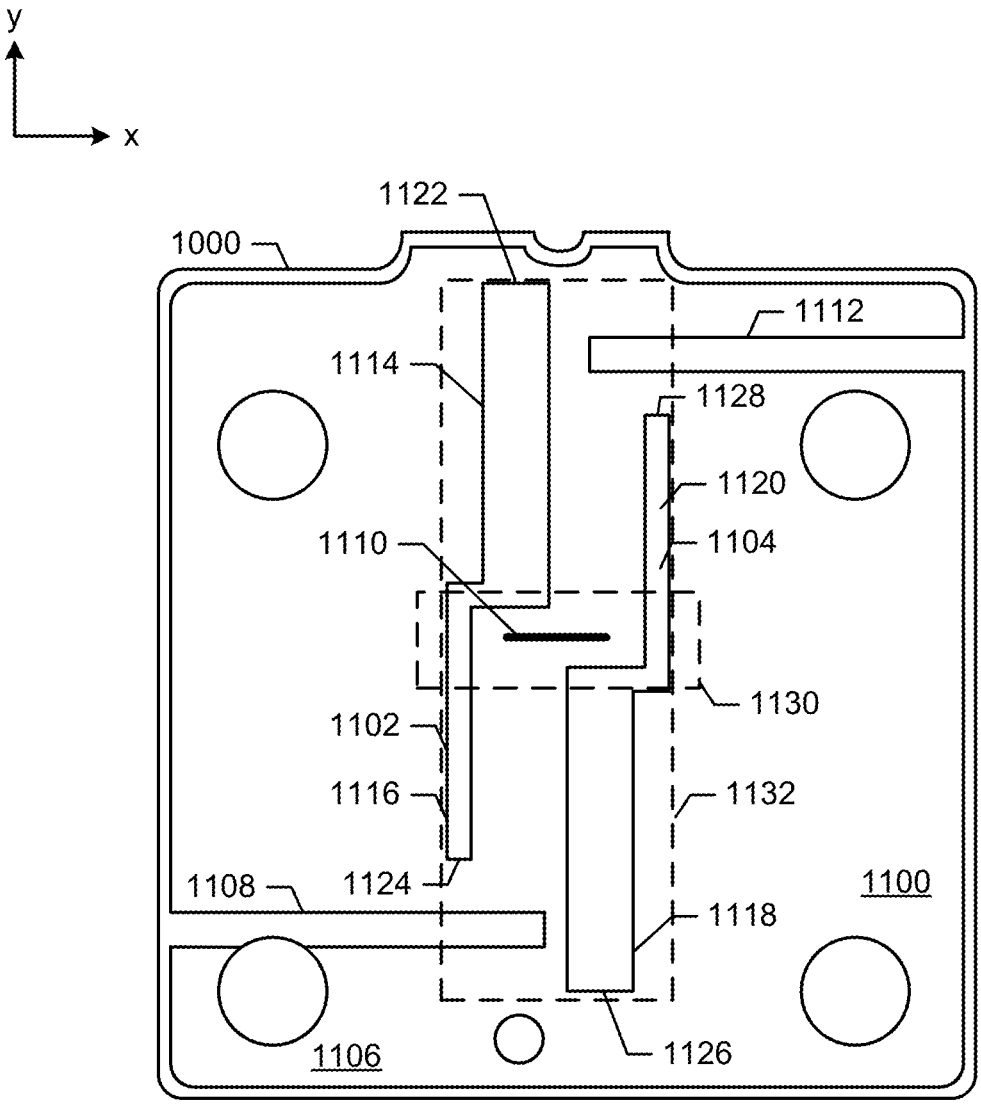
FIG. 11 shows an example antenna board constructed in accordance with teachings of this disclosure.

FIG. 11 illustrates an example implementation of the example antenna board 1000 of FIG. 10 constructed in accordance with teachings of this disclosure. The example antenna board 1000 of FIG. 11 includes a ground plane 1100 into which first and second slot antennas 1102, 1104 are embedded. In the example of FIG. 11, the ground plane 1100 is a copper plate covered, at least partially, in an insulation layer 1106. The example first antenna 1102 is a dual-band antenna that supports first and second transmission frequencies. In the illustrated example, the first antenna 1102 supports 2.4 GHz and 5 GHz. The example second antenna 1104 is also a dual-band antenna. In the illustrated example, the second antenna 1104 supports 2.4 GHz and 5 GHZ.

The example antenna board 1000 of FIG. 11 enables multiple antennas to be disposed behind, for example, the small plastic cover 910 of FIG. 9 while maintaining isolation between the first and second antennas 1102, 1104 to attain a threshold diversity between the first and second antennas 1102, 1104. As the first and second antennas 1102, 1004 are configured in opposing (e.g., orthogonal) configurations on the antenna board 1000, a first radiation pattern of the first antenna 1102 and a second radiation patter of the second antenna 1104 extend from the ground plane 1100 in opposing directions. The opposing directions of the radiation patterns provide wide coverage for the antenna board 1000. That is, in comparison to a single slot antenna deployed behind the plastic cover 910, the example antenna board of FIG. 11 provides multiple radiation patterns extending in multiple different directions, thereby providing increased coverage.

To isolate the first and second antennas 1102, 1104 to achieve the threshold diversity, the example antenna board 1000 of FIG. 11 includes a plurality of isolation slots 1108-1112. The example isolation slots 1108-1112 choke RF current flow between the first and second antennas 1102, 1104. That is, the example isolation slots 1108-1112 of FIG. 11 prevent or reduce current flowing in the second antenna 1104 when the first antenna 1102 is excited, and vice-versa.

The geometry of and spatial relationship between the example first and second antennas 1102, 1104 also provide isolation. The example first antenna 1102 of FIG. 11 includes a first portion or segment 1114 to enable support of 2.4 GHz and a second portion or segment 1116 to enable support of 5 GHz. The example second portion 1116 of the first antenna 1102 has a greater width than the first portion 1114. In FIG. 11, width is shown in the 'x' direction and length is shown in the 'y' direction. However, the width of the illustration may be considered the length, and vice-versa, depending the spatial orientation of the example antenna board 1000. The example second antenna 1104 of FIG. 11 includes a third portion or segment 1118 to enable support of 2.4 GHz and a fourth portion or segment 1120 to enable support of 5 GHz. The example third portion 1118 of the second antenna 1104 has greater width than the fourth portion 1120. In the illustrated example of FIG. 11, the example first portion 1114 of the first antenna 1102 has a substantially similar (e.g., within a threshold) width as the third portion 1118 of the second antenna 1104. Further, in the illustrated example of FIG. 11, the example second portion 1116 of the first antenna 1102 has a substantially similar width as the fourth portion 1120 of the second antenna 1104.

In the example of FIG. 11, the first and second antennas 1102, 1104 are coupled to a current source at a position within a region at or near a center of the antenna board 1000, which is designated with a first box 1130 in FIG. 11. The first and third portions 1114, 1118 have strong (e.g., maximum portions) E-field components radiating from corresponding first and third ends 1122, 1126 at 2.4 GHz. The second and fourth portions 1116, 1120 portions have strong (e.g., maximum) E-field components radiating from corresponding second and fourth ends 1124, 1128. To provide isolation between the strong portions of the respective E-fields at 2.4 GHz, the first end 1122 is spaced apart from the third end 1126 as shown in FIG. 11. Further, to provide isolation between the strong portions of the respective E-fields at 5 GHz, the second end 1124 is spaced apart from the fourth end 1128 as shown in FIG. 11. Thus, at least a portion of the strong components of the respective E-Fields of the different transmission frequencies are isolated by a length between the corresponding ends 1122-1128.

Notably, the example antenna board 1000 of FIG. 11 is particularly useful when space restrictions are imposed by, for example, a size of the opening 908 or the corresponding plastic cover 910. In the illustrated example, the antenna board 1000 of FIG. 11 is deployed in an opening of a metallic surface, such as the metallic grill 902 of FIG. 9, having a width of approximately (e.g., within a threshold) one quarter wavelength of the frequency of the corresponding antenna and a length of approximately (e.g., within a threshold) one half wavelength of the frequency. Such an opening is designated by a second box 1132 in FIG. 11. In the illustrated example, 2.4 GHz has a greater wavelength than 5 GHz. Therefore, the frequency on which the dimensions of the antennas 1102, 1104 and the opening 908 are based is 2.4 GHz. In the illustrated example of FIG. 11, an edge of the first end 1122 and an edge of the third end 1226 are spaced apart by substantially (e.g., within a threshold) one half wavelength of 2.4 GHz. Further, in the illustrated example, outside edges (along the 'x' direction in FIG. 11) of the second and fourth portions 1116, 1120 are spaced apart by substantially one quarter wavelength of 2.4 GHz.

Thus, the configuration, geometry, spatial relationship of the example antenna board 1000 disclosed herein enables two dual-band antennas to be deployed within a slot or opening (represented by the second box 1132 in FIG. 11) as small as one quarter wavelength by one half wavelength, where the wavelength is determined based on a lesser one of the frequencies of the dual-band antennas. The example antenna board 1000 disclosed herein enables such antennas, which provide wide coverage, while maintaining a threshold amount of diversity between the antennas, where the threshold corresponds to a level at which the antennas can meet certain performance metrics or functionality.

VIII. Example Capacitive Coupling

Figure 12:
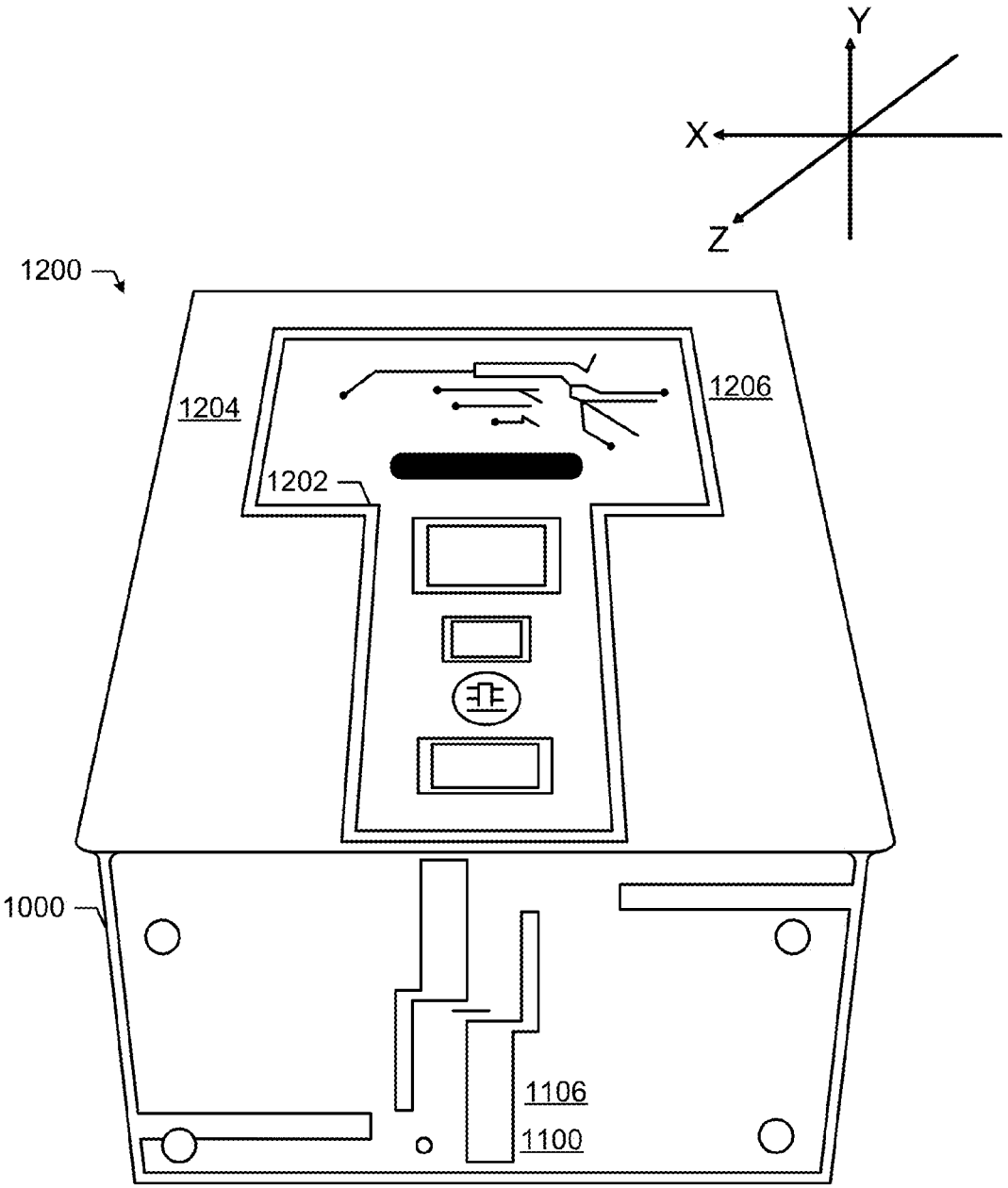
FIG. 12 shows the example antenna board of FIG. 11 positioned adjacent a printed circuit board.

FIG. 12 illustrates an example assembly including the example antenna board 1000 of FIG. 11 used in, for example, any of the example playback devices of FIGS. 1-9. In the example of FIG. 12, the antenna board 1000 is positioned in the device adjacent to an example printed circuit board (PCB) 1202. The example PCB 1202 is a sensing circuit capable of detecting when an object, such as a human finger, is near the assembly 1200. However, the examples disclosed herein can be utilized in connection with any type of PCB or any other component positioned adjacent the example antenna board 1000 that may affect performance of the antenna board 1000. In particular, the example PCB 1202 of FIG. 12 includes a metallic ground plane 1204. In the illustrated example, the ground plane 1204 is a copper plate at least partially covered by an insulation layer 1206, such as a resin.

As described above, the first and second antennas 1102, 1104 of the example antenna board 1000 have radiation patterns that extend away from the antenna board 1000. In the example assembly 1200 of FIG. 12, the radiation pattern(s) of the antenna board 1000 may be affected by the PCB 1202. In particular, the copper plate that forms the ground plane 1204 may reflect signals, restricting or otherwise affecting capture of the signals by the radiation pattern(s) of the antenna board 1000. Put another way, the metallic surfaces of the PCB 1202 are blocking surfaces with respect to the example antenna board 1000 when the PCB 1202 is positioned relative to the antenna board 1000 as shown in FIG. 12 (e.g., at ninety degrees from the antenna board 1000).

Figure 13:
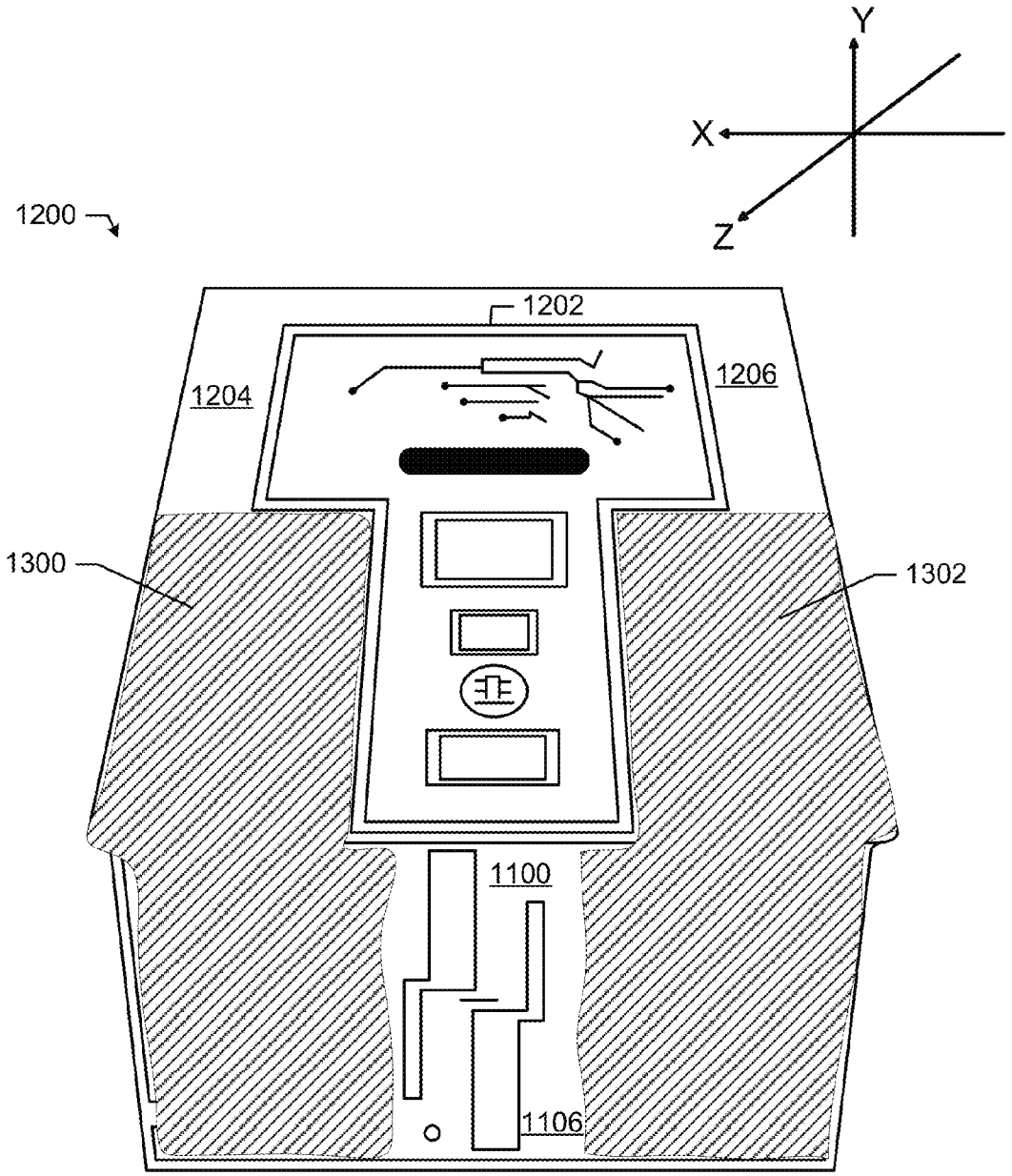
FIG. 13 shows the example antenna board of FIGS. 11 and 12 being capacitively coupled to the example printed circuit board of FIG. 12.

FIG. 13 illustrates an example apparatus and technique disclosed herein to mitigate the negative effects of the blocking surfaces of the PCB 1202 on the antenna board 1000. As shown in FIG. 13, the blocking surfaces of the PCB 1202 may be converted from blocking surfaces into a signal booster for the antenna board 1000. In particular, the example of FIG. 13 includes capacitively coupling the copper plate of the PCB 1202 and the copper plate of the antenna board 1000. To capacitively couple the plates, the example of FIG. 13 includes first and second pieces of conductive adhesive material 1300, 1302, such as copper tape having a conductive adhesive side. In the illustrated example, the example first copper tape 1300 is adhered to one side of the PCB 1202 and one side of the antenna board 1000 and the example second copper tape 1302 is adhered to another side of the PCB 1202 and another side of the antenna board 1000. However, any suitable configuration is possible, such that the individual pieces of tape is adhered to both copper plates. Placement of the tape 1300, 1302 may be selected based on, for example, a least likely area to cause a short-circuit by, for example, creating unintended direct electrical connections.

As described above, the ground plane 1204 of the PCB 1202 and the ground plane 1100 of the antenna board 1000 are each at least partially covered in insulation layers 1206, 1106, respectively. Therefore, the pieces of tape 1300, 1302 are in contact with the insulation layers 1106, 1206. That is, in the illustrated example, no direct contact is had between the tape 1300, 1302 and the copper plates. However, being in close proximity to the copper plates, the pieces of tape 1300, 1302 are in capacitive contact with the copper plates. Accordingly, rather than interfering with the antenna board 1000, the ground plane 1204 of the PCB 1202 acts as a signal booster, in some instances, or least no longer obstructs the radiation patterns of the antennas 1102, 1104. Put another way, the ground plane 1100 of the antenna board 1000 is affectively extended using the example capacitive coupling of FIG. 13.

In some examples, the capacitive coupling between the copper plates is achieved using additional or alternative materials or devices such as, for example, a discrete capacitor or flex PCB with copper ground fill.

In some examples, a capacitive coupling is established between the ground plane 1100 of the antenna board 1000 and the metallic grill 902 of the example playback device 900 of FIG. 9. Such a capacitive coupling can be achieved via, for example, a copper membrane or conductive foam strips disposed between the antenna board 1000 and the metallic grill 902.

Figure 14:
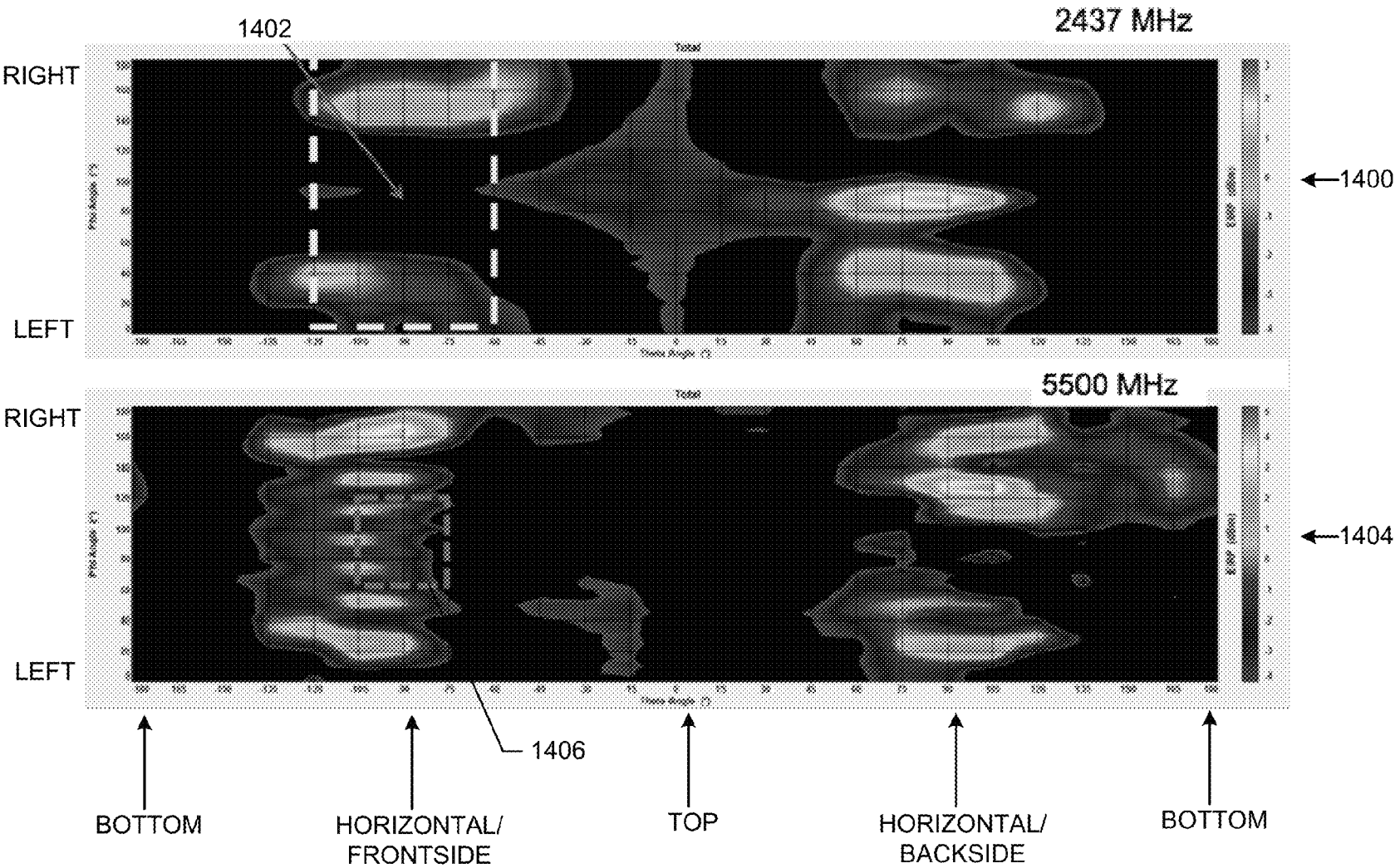
FIGS. 14 and 15 show radiation patterns associated with the example antenna board of FIGS. 10-13.
Figure 15:
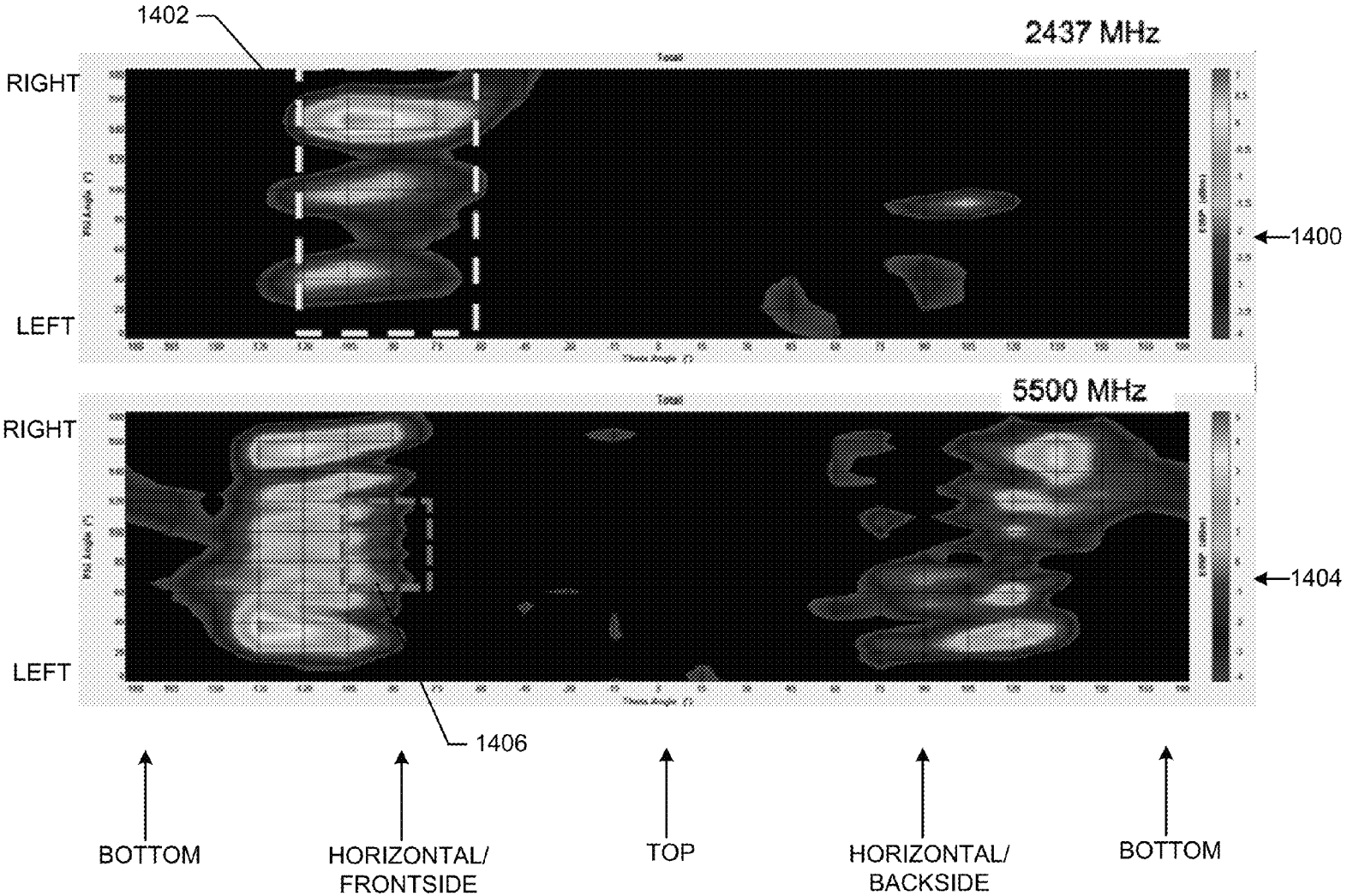

FIGS. 14 and 15 are radiation gain map plots that illustrate the improvement provided by the example capacitive coupling disclosed herein. In particular, the example of FIG. 14 shows radiation gain at different positions associated with, for example, the playback device 900 of FIG. 9 including the assembly 1200 of Figure without the capacitive coupling disclosed in FIG. 13. FIG. 15 shows radiation gain at different positions associated with the playback device 900 with the capacitive coupling of FIG. 13 in place.

The first graph 1400 of FIG. 14 corresponds to 2.4 GHz and includes a first box 1402 corresponding to a forward facing region of the device, which is of particular interest to the example antenna board 1000, as described above. The second graph 1404 of FIG. 14 corresponds to 5 GHz and includes a second box 1406 corresponding to the forward facing region of the device. As indicated in FIG. 14, radiation gain for 2.4 GHz in the first box 1402 is low due at least in part to blocking surfaces of the example assembly 1200, such as the PCB 1202. Although radiation gain for 5 GHz in the second box 1406 is greater than the first box 1402, improvement is possible, as shown in FIG. 15 below. Moreover, portions of the radiation gain, perhaps even peak radiation in the case of 2.4 GHz, are seen in the first and second graphs 1400, 1404 towards to backside of the device, rather than the front of the device (e.g., near the opening 908), as discussed above.

FIG. 15 illustrates the radiation gain associated with the antenna board 1000 with the capacitive coupling of FIG. 13 in place. As shown in FIG. 15, the first box 1402 includes a greater gain and the radiation of the antenna board 1000 for 2.4 GHz and is more concentrated at the front of the device 900. Further, the second box 1406 includes a greater gain and the radiation of the antenna board 1000 for 5 GHz and other areas towards the front of the device 900 and is more concentrated at the front of the device 900.

IX. Conclusion

The descriptions above disclose various example systems, methods, apparatus, and articles of manufacture including, among other components, firmware and/or software executed on hardware. However, such examples are merely illustrative and should not be considered as limiting. For example, it is contemplated that any or all of these firmware, hardware, and/or software components can be embodied exclusively in hardware, exclusively in software, exclusively in firmware, or in any combination of hardware, software, and/or firmware. Accordingly, while the following describes example systems, methods, apparatus, and/or articles of manufacture, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

Processes associated with examples disclosed herein may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, processes may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disc and to exclude propagating signals. As used herein, when the phrase "at least" is used as the transition term in a preamble of a claim, it is open-ended in the same manner as the term "comprising" is open ended.

As described above, the present disclosure involves configurations for antennas. An example disclosed playback device includes a housing having a metallic face, the metallic face including an opening; a first antenna oriented in a first direction on a plate, the plate forming a ground plane for the first antenna, the first antenna having a first slot aligned with the opening, the first antenna being associated with a first frequency; and a second antenna positioned proximate to the first antenna on the plate and oriented in a second direction opposing the first direction, the second antenna having a second slot aligned with the opening, the second antenna being associated with at least the first frequency, and the second antenna having at least a first portion located at a distance from at least a second portion of the first antenna of one quarter wavelength of the first frequency.

In some examples of the playback device, the second antenna has at least a third portion located at a second distance from at least a fourth portion of the first antenna of one half wavelength of the first frequency.

In some examples of the playback device, the opening has a first dimension substantially equal to one quarter wavelength of the first frequency and a second dimension substantially equal to one half wavelength of the first frequency.

In some examples of the playback device, the plate comprises copper.

In some examples of the playback devices, the playback device includes an isolation slot to isolate the first antenna and the second antenna.

In some examples of the playback device, the first antenna is further associated with a second frequency; and wherein the second antenna is further associated with the second frequency.

In some examples of the playback device, the metallic face is a speaker grill.

An example disclosed playback device includes a plate to form a ground plane; a first antenna on the plate having a first segment associated with a first frequency and a second segment associated with a second frequency; and a second antenna on the plate having a third segment associated with the first frequency and a second segment associated with the second frequency, wherein a first edge of the first segment is located a half wavelength of the first frequency from a second edge of the third segment, and wherein the plate is positioned adjacent an opening in a metallic face having a first dimension of substantially the half wavelength of the first frequency.

In some examples of the playback device, a third edge of the second segment is located a quarter wavelength of the first frequency from a fourth edge of the fourth segment, and wherein the opening in the metallic face has a second dimension of substantially the quarter wavelength of the first frequency.

In some examples of the playback device, a first radiation pattern associated with the first antenna extends in a first direction, and a second radiation pattern associated with the second antenna extends in a second direction opposing the first direction.

In some examples of the playback device, the playback device includes a first isolation slot located between the first and second antennas on the plate.

In some examples of the playback device, the playback device includes a second isolation slot located on the plate.

An example disclosed playback device includes a housing face having a first interference factor, the housing face includes an opening in which a cover is placed, the cover having a second interference factor less than the first interference factor, wherein the opening has a first dimension substantially one half wavelength of a first frequency supported by the playback device and a second dimension substantially one quarter wavelength of the first frequency; and an antenna board formed by a plate and aligned with the opening, the antenna board comprising: a first antenna having a first segment to support the first frequency and a second segment to support a second frequency; and a second antenna having a third segment to support the first frequency and a fourth segment to support the second frequency, wherein the second antenna is positioned in an opposing configuration from the first antenna, wherein a first edge of the first segment is located the half wavelength of the first frequency from a second edge of the third segment, and wherein a third edge of the second segment is located the quarter wavelength of the first frequency from a fourth edge of the fourth segment.

In some examples of the playback device, a first radiation pattern of the first antenna extends in a first direction, and a second radiation pattern of the second antenna extends in a second direction opposing the first direction.

In some examples of the playback device, the playback device includes a first isolation slot perpendicular to the first and second antennas.

In some examples of the playback device, the playback device includes a second isolation slot perpendicular to the first and second antennas.

In some examples of the playback device, the first frequency is 2.4 GHz.

In some examples of the playback device, the second frequency is 5 GHz.

In some examples of the playback device, the first and second antennas are slot antennas embedded in the antenna board.

In some examples of the playback device, the housing face is a metallic grill and the cover is plastic.

An example disclosed apparatus includes a first plate forming a first ground plane for an antenna; a second plate forming a second ground plane for a circuit, wherein a first edge of the first plate is orthogonally adjacent to a second edge of the second plate; and a coupler to form a capacitive coupling between the first ground plane and the second ground plane.

In some examples of the apparatus, the first plate includes a first insulator and the second plate includes a second insulator, and wherein the first and second insulators prevent direct contact between the first and second ground planes.

In some examples of the apparatus, the coupler comprises metallic tape.

In some examples of the apparatus, the metallic tape comprises a conductive adhesive.

In some examples of the apparatus, the metallic tape extends along the first plate and along the second plate.

In some examples of the apparatus, the metallic tape is positioned on first and second sides of the first plate, and the antenna is located between the first and second sides of the first plate.

In some examples of the apparatus, the metallic tape is positioned on first and second sides of the second plate, and the circuit is located between the first and second sides of the second plate.

In some examples of the apparatus, the coupler comprises a discrete capacitor.

An example disclosed apparatus includes an antenna assembly arranged on a first surface corresponding to a first ground plane of the antenna assembly; a sensing circuit arranged on a second surface corresponding to a second ground plane of the sensing circuit, wherein the first ground plane is not in direct contact with the second ground plane;

and a capacitive coupler to capacitively couple the first ground plane to the second ground plane to extend the first ground plane to the second surface.

In some examples of the apparatus, the first surface is orthogonal to the second surface.

In some examples of the apparatus, the capacitive coupler is to capacitively couple a first portion of the first surface to a second portion of the second surface.

In some examples of the apparatus, the apparatus includes a second capacitive coupler to capacitively couple a third portion of the first surface to a fourth portion of the second surface.

In some examples of the apparatus, the capacitive coupler comprises metallic tape having conductive adhesive.

An example disclosed playback device includes a metallic grill having an aperture to be covered by a plastic cover; an antenna assembly comprising a first slot antenna opposing a second slot antenna along a first ground plane, wherein first and second radiation patterns of the first and second slot antennas are aligned with the aperture; a printed circuit board having a second ground plane positioned orthogonal to the first ground plane; and metallic tape capacitively coupling the first ground plane to the second ground plane, wherein the first and second ground planes are not in direct contact.

In some examples of the playback device, the first ground plane is insulated by a first insulation layer and the second ground plane is insulated by a second insulated layer.

In some examples of the playback device, the metallic tape is adhered to the first and second insulation layers.

In some examples of the playback device, the metallic tape comprises a first piece of metallic tape adhered to a first portion of the antenna assembly and a second piece of metallic tape adhered to a second portion of the antenna assembly.

In some examples of the playback device, the first and second slot antennas are positioned between the first and second pieces of metallic tape.

In some examples of the playback device, the printed circuit board comprises a sensing circuit.

In some examples of the playback device, the first and second ground planes are prevented from direct contact.

When any of the appended claims are read to cover a purely software and/or firmware implementation, at least one of the elements in at least one example is hereby expressly defined to include a tangible medium such as a memory, DVD, CD, Blu-ray, and so on, storing the software and/or firmware.

I claim:

1. A playback device, comprising:

a housing having a metallic face, the metallic face including an opening;

a first antenna oriented in a first direction on a plate, the plate forming a ground plane for the first antenna, the first antenna having a first slot aligned with the opening, the first antenna being associated with a first frequency; and a second antenna positioned proximate to the first antenna on the plate and oriented in a second direction opposing the first direction, the second antenna having a second slot aligned with the opening, the second antenna being associated with at least the first frequency, and the second antenna having at least a first portion located at a distance from at least a second portion of the first antenna of one quarter wavelength of the first frequency.

2. The playback device of claim 1, the second antenna having at least a third portion located at a second distance from at least a fourth portion of the first antenna of one half wavelength of the first frequency.

3. The playback device of claim 1, wherein the opening has a first dimension substantially equal to one quarter wavelength of the first frequency and a second dimension substantially equal to one half wavelength of the first frequency.

4. The playback device of claim 1, wherein the plate comprises copper.

5. The playback device of claim 1, further comprising an isolation slot to isolate the first antenna and the second antenna.

6. The playback device of claim 1, wherein the first antenna is further associated with a second frequency; and wherein the second antenna is further associated with the second frequency.

7. The playback device of claim 1, wherein the metallic face is a speaker grill.

8. A playback device, comprising:

a plate to form a ground plane;

a first antenna on the plate having a first segment associated with a first frequency and a second segment associated with a second frequency; and a second antenna on the plate having a third segment associated with the first frequency and a fourth segment associated with the second frequency, wherein a first edge of the first segment is located a half wavelength of the first frequency from a second edge of the third segment, and wherein the plate is positioned adjacent an opening in a metallic face having a first dimension of substantially the half wavelength of the first frequency.

9. A playback device as defined in claim 8, wherein a third edge of the second segment is located a quarter wavelength of the first frequency from a fourth edge of the fourth segment, and wherein the opening in the metallic face has a second dimension of substantially the quarter wavelength of the first frequency.

10. A playback device as defined in claim 8, wherein a first radiation pattern associated with the first antenna extends in a first direction, and a second radiation pattern associated with the second antenna extends in a second direction opposing the first direction.

11. A playback device as defined in claim 8, further comprising a first isolation slot located between the first and second antennas on the plate.

12. A playback device as defined in claim 11, further comprising a second isolation slot located on the plate.

13. A playback device, comprising:

a housing face having a first interference factor, the housing face includes an opening in which a cover is placed, the cover having a second interference factor less than the first interference factor, wherein the opening has a first dimension substantially one half wavelength of a first frequency supported by the playback device and a second dimension substantially one quarter wavelength of the first frequency; and an antenna board formed by a plate and aligned with the opening, the antenna board comprising:

a first antenna having a first segment to support the first frequency and a second segment to support a second frequency; and a second antenna having a third segment to support the first frequency and a fourth segment to support the second frequency, wherein the second antenna is positioned in an opposing configuration from the first antenna, wherein a first edge of the first segment is located the half wavelength of the first frequency from a second edge of the third segment, and wherein a third edge of the second segment is located the quarter wavelength of the first frequency from a fourth edge of the fourth segment.

14. A playback device as defined in claim 13, wherein a first radiation pattern of the first antenna extends in a first direction, and a second radiation pattern of the second antenna extends in a second direction opposing the first direction.

15. A playback device as defined in claim 13, further comprising a first isolation slot perpendicular to the first and second antennas.

16. A playback device as defined in claim 13, further comprising a second isolation slot perpendicular to the first and second antennas.

17. A playback device as defined in claim 13, wherein the first frequency is 2.4 GHz.

18. A playback device as defined in claim 13, wherein the second frequency is 5 GHz.

19. A playback device as defined in claim 13, wherein the first and second antennas are slot antennas embedded in the antenna board.

20. A playback device as defined in claim 13, wherein the housing face is a metallic grill and the cover is plastic.

* * * * *